US007173612B2

(12) United States Patent
Nanno et al.

(10) Patent No.: US 7,173,612 B2
(45) Date of Patent: Feb. 6, 2007

(54) EL DISPLAY DEVICE PROVIDING MEANS FOR DELIVERY OF BLANKING SIGNALS TO PIXEL ELEMENTS

(75) Inventors: Yutaka Nanno, Kobe (JP); Kouji Senda, Nagaokakyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 410 days.

(21) Appl. No.: 10/433,296

(22) PCT Filed: Dec. 10, 2001

(86) PCT No.: PCT/JP01/10810

§ 371 (c)(1),
(2), (4) Date: Jul. 30, 2003

(87) PCT Pub. No.: WO02/47062

PCT Pub. Date: Jun. 13, 2002

(65) Prior Publication Data

US 2004/0113872 A1 Jun. 17, 2004

(30) Foreign Application Priority Data

Dec. 8, 2000 (JP) ..... 2000-373704
May 9, 2001 (JP) ..... 2001-138139

(51) Int. Cl.
*G09G 5/00* (2006.01)

(52) U.S. Cl. ..... 345/211; 345/76

(58) Field of Classification Search ..... 345/76, 345/78, 82–83, 214, 208, 211; 315/169.3
See application file for complete search history.

(56) References Cited

U.S. PATENT DOCUMENTS 4,006,383 A * 2/1977 Luo et al. ..... 315/169.3
5,157,524 A * 10/1992 Dijon et al. ..... 349/144
5,172,108 A * 12/1992 Wakabayashi et al. ..... 345/691
5,684,365 A 11/1997 Tang et al. ..... 315/169.3
5,952,789 A 9/1999 Stewart et al. ..... 315/169.4
6,011,529 A * 1/2000 Ikeda ..... 345/77
6,246,180 B1 * 6/2001 Nishigaki ..... 315/169.3
6,335,778 B1 1/2002 Kubota et al. ..... 349/151

(Continued)

FOREIGN PATENT DOCUMENTS

EP 1 037 192 A2 9/2000

(Continued)

*Primary Examiner*—Kent Chang
(74) *Attorney, Agent, or Firm*—Steptoe & Johnson LLP

(57) ABSTRACT

An EL display device 1 includes a display portion 2 having unit pixels 10 arranged in a matrix, a source line driver circuit 6, and a gate line driver circuit 4. Each of the unit pixels 10 has an EL element 11, a switching transistor Tr1, a driver transistor Tr2, and an auxiliary capacitor 13. The auxiliary capacitor 13 has electrodes, one connected to a gate electrode of the transistor Tr2 and the other to a next gate line GL. The gate line driver circuit 4 outputs, via the next gate line GL, blanking signals for forcibly stopping a light-emitting state of the EL elements 11, within hold times in which the voltages written to the gate electrodes of the transistors Tr2 are held. With such a configuration, a blanking period where the EL elements do not emit light, is inserted in one frame.

6 Claims, 33 Drawing Sheets

U.S. PATENT DOCUMENTS

| | | | | |
|---|---|---|---|---|
| 6,400,348 | B1 * | 6/2002 | Young | 345/78 |
| 6,611,245 | B1 * | 8/2003 | Edwards | 345/76 |
| 6,847,172 | B2 * | 1/2005 | Suzuki | 315/169.3 |
| 6,847,341 | B2 * | 1/2005 | Kimura et al. | 345/78 |
| 6,859,193 | B1 * | 2/2005 | Yumoto | 345/82 |

FOREIGN PATENT DOCUMENTS

| | | |
|---|---|---|
| EP | 1 061 497 A1 | 12/2000 |
| JP | 61-22326 | 1/1986 |
| JP | 6-325869 | 11/1994 |
| JP | 8-234683 | 9/1996 |
| JP | 8-241047 | 9/1996 |
| JP | 10-68931 | 3/1998 |
| JP | 10-319908 | 12/1998 |
| JP | 2000-221942 | 8/2000 |
| JP | 2000-276075 | 10/2000 |
| JP | 2000-276078 | 10/2000 |
| JP | 2000-330527 | 11/2000 |
| JP | 2001-60076 | 3/2001 |

* cited by examiner 15
12.4
10
7.4
5
0
Voltage (V)
Time (sec)

17.5
15
12.4
10
5
0
Voltage (V)
Gate Line
in question
T1 T2
T3
T4 T5
Time (sec)

17.5
15
12.4
10
5
0
Voltage (V)
Next Gate Line
Time (sec)

Vs
12.4(Non-light-emission)
7.4(Light-emission)

BLn-1
5V
Blanking Period
Light-emission
B
A

GLn-1
12.4

BLn
0
5V
Blanking Period
Light-emission

GLn
12.4
Timing
0
T1
T2
T3
T4
T5
T6

PRIOR ART

PRIOR ART

EL DISPLAY DEVICE PROVIDING MEANS FOR DELIVERY OF BLANKING SIGNALS TO PIXEL ELEMENTS

TECHNICAL FIELD

The present invention relates to an EL (electroluminescent) display device.

BACKGROUND ART

The configuration of a unit pixel of a prior-art EL display device is shown in FIGS. 32 and 33. In FIGS. 32 and 33, reference symbol GL indicates a gate line, reference numeral 13 indicates an auxiliary capacitor, reference symbol SL indicates a source line, reference numeral 11 indicates an EL element, reference symbol Tr1 indicates a switching transistor, reference symbol Tr2 indicates a driver transistor, and reference numeral 70 indicates a current-supplying line for supplying a current to the EL element 11. The EL element 11 emits light as follows. First, when the gate line GL and the source line SL are both turned on, an electric charge is stored in the auxiliary capacitor 13 via the switching transistor Tr1. Since the auxiliary capacitor 13 continues to apply a voltage to a gate of the driver transistor Tr2, even when the switching transistor Tr1 is turned off, a current continues to flow from the current-supplying line 70 to the EL element 11, and thus the EL element is driven to emit light by a current in response to the current image signal, until an image signal is written in the present frame.

In the above prior-art example, the EL element continues to emit light during one frame period. Thus, when displaying a moving image, due to an after-image phenomenon, an image of the previous frame is superimposed over an image of the present frame, and accordingly the image observer perceives the image to be fuzzy (see 2001 FPD Technology Outlook, p. 122).

As a solution to such a case, it is known that by inserting a blanking period (which means a period where light emission of the EL elements stop and the entire screen goes into a black display state) while an image of one frame is displayed, an after-image is suppressed, clarifying the image.

Based on such a concept, Japanese Unexamined Patent Publication No. 2000-221942 discloses a configuration in which transistors dedicated to providing blanking signals are provided and the blanking signals are turned on at a given time immediately before the next one frame period starts.

The above-described configuration, however, requires a dedicated transistor for each pixel and controlling lines for providing blanking signals. Thus, an increase in the area occupied by the dedicated transistors and controlling lines reduces the aperture ratio of the pixels. In addition, additional provision of the dedicated transistors and controlling lines brings about a reduction in yield of panels.

DISCLOSURE OF THE INVENTION

It is an object of the present invention to overcome the foregoing problems by providing an EL display device in which an after-image is suppressed to achieve the perception of a clear image, without causing a reduction in the aperture ratio of the pixels.

In order to overcome the foregoing problems, according to a first aspect of the present invention there is provided an EL display device comprising: a display portion including a plurality of gate lines, to which scan signals are supplied, a plurality of source lines, to which image signals are supplied, and unit pixels arranged in a matrix, each of the unit pixels having an EL element, a driver transistor for controlling, via a current-supplying line, the amount of current supplied to the EL element, and a switching transistor in which switching operation changes with a scan signal, the switching transistor switching, according to change of the switching operation, between conduction and blocking between the source line and a gate electrode of the driver transistor; a source line driver circuit for supplying image signals to the source lines; and a gate line driver circuit for supplying scan signals to the gate lines and outputting, via the gate lines, blanking signals, within hold times in which voltages written to the gate electrodes of the driver transistors are held, the blanking signals forcibly stopping a light-emitting state of the EL elements.

With this configuration, an EL element in each pixel emits light in response to an image signal, thereby displaying a desired image, and a blanking period where the EL elements do not emit light, is inserted in one frame. Accordingly, when displaying a moving image, a black display is inserted between an image of the previous frame and an image of the present frame. Consequently, an after-image phenomenon is suppressed, making it possible to perceive a clear image.

In addition, when the blanking signals are supplied via the gate lines, it is not necessary to provide transistors dedicated to blanking and wiring for blanking signals. Thus, omission of such transistors and wiring improves the aperture ratio.

It is to be noted that the term "stop" includes not only a state in which a light-emitting state completely stops, but also a state that is close to a complete stop.

According to a second aspect of the present invention, the EL display device of the first aspect may be such that the blanking signals are signals for forcibly setting the driver transistors to an OFF state.

As used herein, the term "OFF state" includes not only a complete OFF state, but also a state that is close to the complete OFF state (i.e., an extremely weak ON state).

According to a third aspect of the present invention, the EL display device of the second aspect may be such that: the unit pixels each comprise an auxiliary capacitor having electrodes, one connected to the gate electrode of the driver transistor and the other to a designated gate line selected from any one of the plurality of gate lines; and the blanking signals are provided from the designated gate line to the gate electrodes of the driver transistors via the auxiliary capacitors.

According to a fourth aspect of the present invention, the EL display device of the third aspect may be such that the designated gate line is a gate line next to a gate line connected to a selected pixel.

For example, it is also possible to use, as a designated gate line, the gate line to which a selected pixel itself belongs. In this case, however, with a transition from the ON to OFF state of the selected pulse, due to the influence of the parasitic capacitors of the driver transistors connected to the gate line to which the pixel itself belongs, the potential of the pixel electrodes is expected to change; in order to prevent this from happening, a large storage capacitor needs to be added. In view of this, by making the next gate line serve as the designated gate line, such a problem can be overcome. In addition, when the next gate line serves as the designated gate line, the routing of the lines can be done with a minimum length.

According to a fifth aspect of the present invention, the EL display device of the fourth aspect may be such that the switching transistors and the driver transistors are P-channel transistors, anode electrodes of the EL elements are configured as pixel electrodes, and cathode electrodes of the EL elements are configured as counter electrodes.

With this configuration, the driving voltage of the entire display device can be made small compared to the case of using transistors with different polarities.

According to a sixth aspect of the present invention, the EL display device of the fourth aspect may be such that the switching transistors and the driver transistors are N-channel transistors, cathode electrodes of the EL elements are configured as pixel electrodes, and anode electrodes of the EL elements are configured as counter electrodes.

With this configuration too, the driving voltage of the entire display device can be made small compared to the case of using transistors with different polarities.

According to a seventh aspect of the present invention, the EL display device of the fourth aspect may be such that the switching transistors have a multi-gate structure in which a plurality of transistors are connected to each other in series.

For the switching transistors, such characteristics as small leak current are required, i.e., those having excellent data storage characteristics are preferably used. Thus, when the switching transistors are configured to have a multi-gate structure, as with the above configuration, excellent off characteristics can be obtained.

According to an eighth aspect of the present invention, the EL display device of the fourth aspect may be such that the switching transistors have an LDD (Lightly Doped Drain) structure.

With this configuration, excellent off characteristics can be obtained, as with the seventh aspect of the present invention.

According to a ninth aspect of the present invention, the EL display device of the fourth aspect may be such that: each of the unit pixels is split into a plurality of sub-pixels; the sub-pixels each individually comprise a sub-pixel electrode, a switching transistor, a controlling transistor, an auxiliary capacitor, and a gate line; and gray-scale display is provided by combination of ON/OFF states of each of the sub-pixels, and a blanking signal is provided to each of the sub-pixels via the gate line.

With this configuration, an EL display device with excellent gray-scale performance can be configured.

According to a tenth aspect of the present invention, the EL display device of the ninth aspect may be such that areas of light-emitting portions of the EL elements in the sub-pixels are weighted so as to correspond to bits to be input according to gray-scale to be displayed.

When the area ratio of the light-emitting portions of the sub-pixels, which compose one unit pixel, is weighted so as to correspond to bits such as 1:2:4: . . . :$2^{(n-1)}$, it becomes possible to provide $2^n$-gray-scale display.

According to an eleventh aspect of the present invention, the EL display device of the fourth aspect may be such that the switching transistors and the driver transistors are made of polysilicon.

Polysilicon has higher mobility than amorphous silicon and thus microfabrication of elements is easily obtained. Therefore, this configuration is advantageous particularly when a plurality of transistors are used in one pixel, such as the case with this aspect of the present invention.

According to a twelfth aspect of the present invention, the EL display device of the fourth aspect may be such that the driver transistors are operated in a linear region.

By thus operating the driver transistors in the linear region, even if variations occur in the threshold of the driver transistors or in the voltage applied to the gates of the driver transistors, the current value cannot be affected much. Hence, even transistors with bad characteristics such as those having been conventionally considered to be unusable can be used.

According to a thirteenth aspect of the present invention, the EL display device of the first aspect may be such that: a designated gate line selected from any one of the plurality of gate lines is connected to anode electrodes of the EL elements via controlling transistors, and cathode electrodes of the EL elements are configured as counter electrodes; the designated gate line also serves as the current-supplying line, and the EL elements are driven to emit light by current flowing from the designated gate line to the EL elements; and the blanking signals are supplied from the designated gate line and are signals set to a voltage level lower than a potential of the cathode electrodes of the EL elements.

When a current is supplied from the designated gate line to the EL elements, as with the above configuration, it is not necessary to provide a current-supplying line dedicated to supplying currents to the EL elements. Consequently, the aperture ratio can be increased compared to the prior-art example, and the occurrence of line defects caused by interlayer or intralayer short circuits resulting from the current-supplying line can be prevented, making it possible to configure an EL display device with improved yield.

According to a fourteenth aspect of the present invention, the EL display device of the first aspect may be such that: a designated gate line selected from any one of the plurality of gate lines is connected to cathode electrodes of the EL elements via controlling transistors, and anode electrodes of the EL elements are configured as counter electrodes; the designated gate line also serves as the current-supplying line, and the EL elements are driven to emit light by current flowing from the EL elements to the designated gate line; and the blanking signals are supplied from the designated gate line and are signals set to a voltage level higher than a potential of the anode electrodes of the EL elements.

This configuration also exhibits the same advantageous effects as those of the thirteenth aspect of the present invention.

According to a fifteenth aspect of the present invention, the EL display device of the thirteenth aspect may be such that the designated gate line is an antecedent gate line.

As with the effects of the fourth aspect of the present invention, a change in the potential of the pixel electrodes, resulting from the parasitic capacitors of the transistors, can be suppressed without the need to add a large storage capacitor.

According to a sixteenth aspect of the present invention, the EL display device of the thirteenth aspect may be such that the sum of impedance of the designated gate line and output impedance of a buffer in last stage in the gate line driver circuit connected to the designated gate line is 20% or less of impedance of the EL elements connected to the designated gate line.

The reason for controlling the impedance is that when the impedance exceeds 20%, the potential of the ends of the gate lines decreases and a sufficient voltage cannot be applied to the EL elements, and accordingly a uniform display cannot be obtained.

According to a seventeenth aspect of the present invention, the EL display device of the thirteenth aspect may be such that: each of the unit pixels is split into a plurality of sub-pixels; the sub-pixels each individually have a sub-pixel electrode, a switching transistor, a controlling transistor, an auxiliary capacitor, and a gate line; and gray-scale display is provided by combination of ON/OFF states of each of the sub-pixels, and a blanking signal is provided to each of the sub-pixels via the gate line.

With this configuration, an EL display device with excellent gray-scale performance can be configured.

According to an eighteenth aspect of the present invention, the EL display device of the seventeenth aspect may be such that areas of light-emitting portions of the EL elements in the sub-pixels are weighted so as to correspond to bits to be input according to gray-scale to be displayed.

When the area ratio of the light-emitting portions of the sub-pixels, which compose one unit pixel, is weighted so as to correspond to bits such as 1:2:4: . . . :$2^{(n-1)}$, it becomes possible to provide $2^n$-gray-scale display.

According to a nineteenth aspect of the present invention there is provided an EL display device having a plurality of gate lines, to which scan signals are supplied, a plurality of source lines, to which image signals are supplied, and unit pixels arranged in a matrix, each of the unit pixels having an EL element, a driver transistor for controlling the amount of current flowing to the EL element, and a switching transistor in which switching operation changes with a scan signal, the switching transistor switching, according to change of the switching operation, between conduction and blocking between the source line and a gate electrode of the driver transistor, the EL display device comprising: blanking signal lines, to which blanking signals are supplied within hold times in which voltages written to the gate electrodes of the driver transistors are held, the blanking signals forcibly setting the driver transistors to an OFF state, the blanking signal lines each being provided to each row of the unit pixels arranged in a matrix; a blanking signal driver circuit for supplying blanking signals from the blanking signal lines; and auxiliary capacitors each being provided to each of the unit pixels, each of the auxiliary capacitors having electrodes, one connected to the gate electrode of the driver transistor and the other to the blanking signal line; wherein the blanking signals are provided from the blanking signal lines to the gate electrodes of the driver transistors via the auxiliary capacitors.

With this configuration, it is not necessary to provide transistors dedicated to blanking, and accordingly, omission of such transistors improves the aperture ratio.

According to a twentieth aspect of the present invention, the EL display device of the nineteenth aspect may be such that the blanking signal lines are individually connected to the blanking signal driver circuit.

With this configuration, the blanking signals are supplied to the blanking signal lines, each at different timing.

According to a twenty-first aspect of the present invention, the EL display device of the nineteenth aspect may be such that the blanking signal lines are connected to the blanking signal driver circuit via one common line.

With this configuration, the blanking signals are supplied from the blanking signal line, all at the same timing.

BRIEF DESCRIPTION OF THE DRAWINGS

FIG. 6(*a*) is a waveform diagram of an image signal voltage, FIG. 6(*b*) is a waveform diagram of the voltage of a gate line GLa, and FIG. 6(*c*) is a waveform diagram of the voltage of a gate line GLb.

FIG. 9(*a*) is a waveform diagram of an image signal voltage, FIG. 9(*b*) is a waveform diagram of the voltage of a gate line GLc, and FIG. 9(*c*) is a waveform diagram of the voltage of a gate line GLd.

FIG. 21(*a*) is a waveform diagram of an image signal voltage, FIG. 21(*b*) is a waveform diagram of the voltage of a gate line GLa, and FIG. 21(*c*) is a waveform diagram of the voltage of a gate line GLb.

FIG. 24(*a*) is a waveform diagram of an image signal voltage, FIG. 24(*b*) is a waveform diagram of the voltage of a gate line GLa, and FIG. 24(*c*) is a waveform diagram of the voltage of a gate line GLb.

BEST MODE FOR CARRYING OUT THE INVENTION

Embodiment 1

Figure 1:
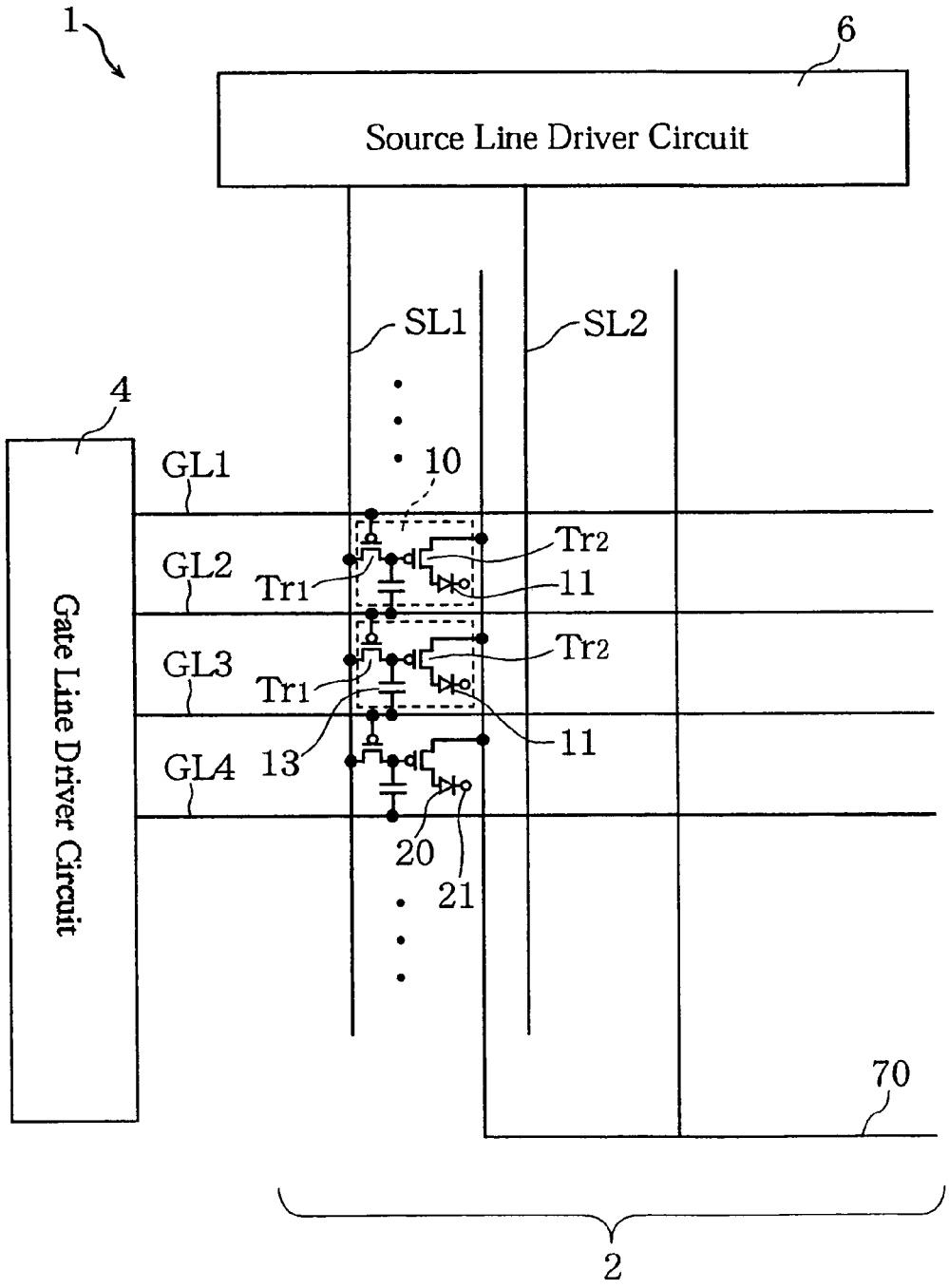
FIG. 1 is a circuit diagram showing the configuration of an EL display device according to Embodiment 1.

FIG. 1 is a circuit diagram showing the configuration of an active matrix type EL display device according to Embodiment 1. An active matrix type EL display device 1 includes a display portion 2 having unit pixels 10 arranged in a matrix, a gate line driver circuit 4 for outputting scan signals to each of the unit pixels 10 via gate lines GL1, GL2, . . . (reference symbol GL will be used when collectively referring to the gate lines), a source line driver circuit 6 for outputting image signals to each of the unit pixels 10 via source lines SL1, SL2, . . . (reference symbol SL will be used when collectively referring to the source lines), and a current-supplying line 70 for supplying a current to each EL element 11.

The unit pixels 10 each includes the EL element 11, serving as an emitter of the unit pixel, a switching transistor Tr1, a driver transistor Tr2 for controlling the amount of driving current provided to the EL element 11, and an auxiliary capacitor 13. The auxiliary capacitor 13 has electrodes, one connected to a next gate line GL, serving as a designated gate line, and the other commonly connected to a gate of the driver transistor Tr2 and a drain of the switching transistor Tr1. The transistors Tr1 and Tr2 are both thin film transistors (TFTs) of the same polarity, and are P-channel transistors in Embodiment 1.

Figure 2:
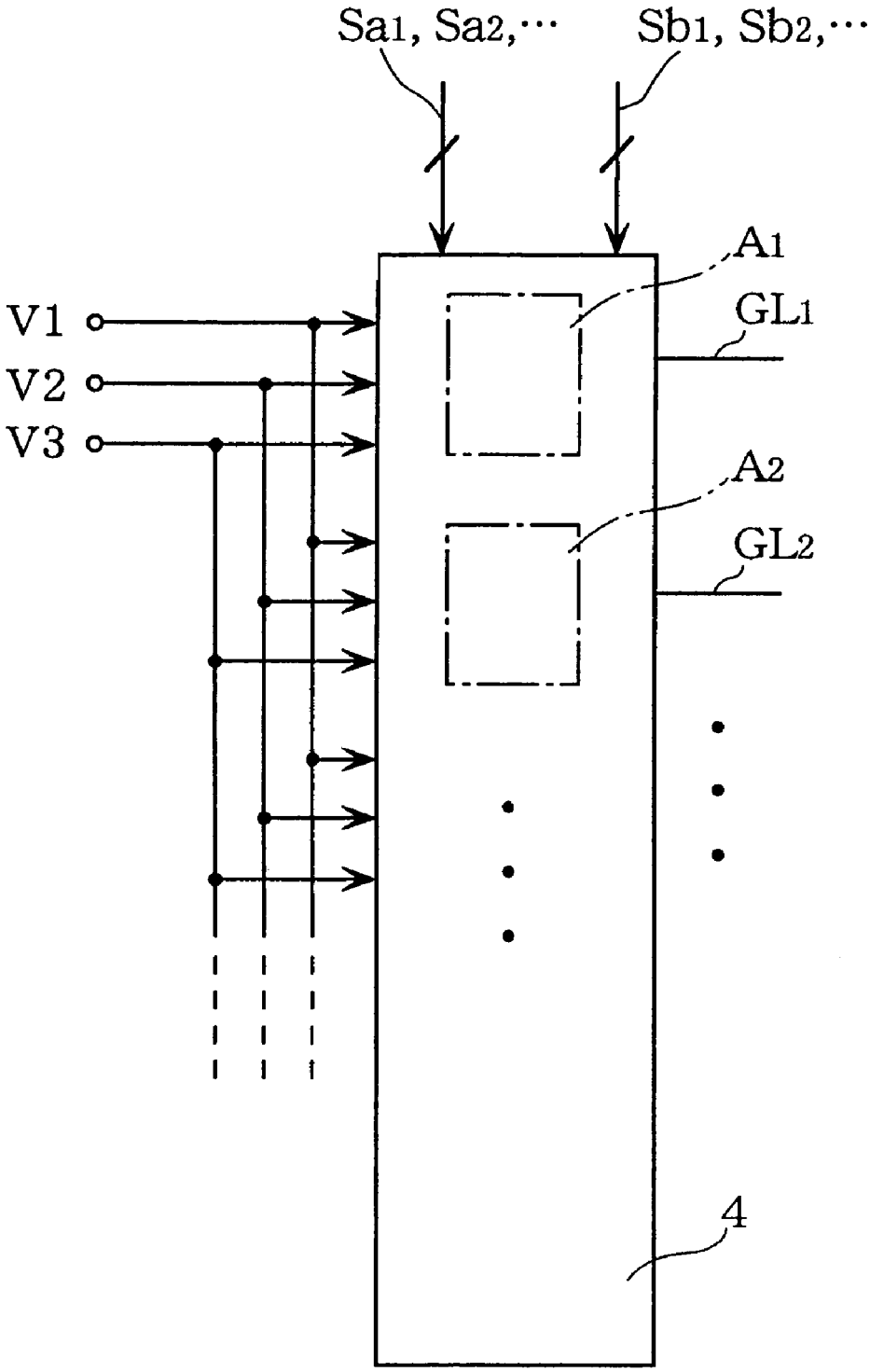
FIG. 2 is a circuit diagram showing the configuration of a gate line driver circuit used in the EL display device according to Embodiment 1.
Figure 3:
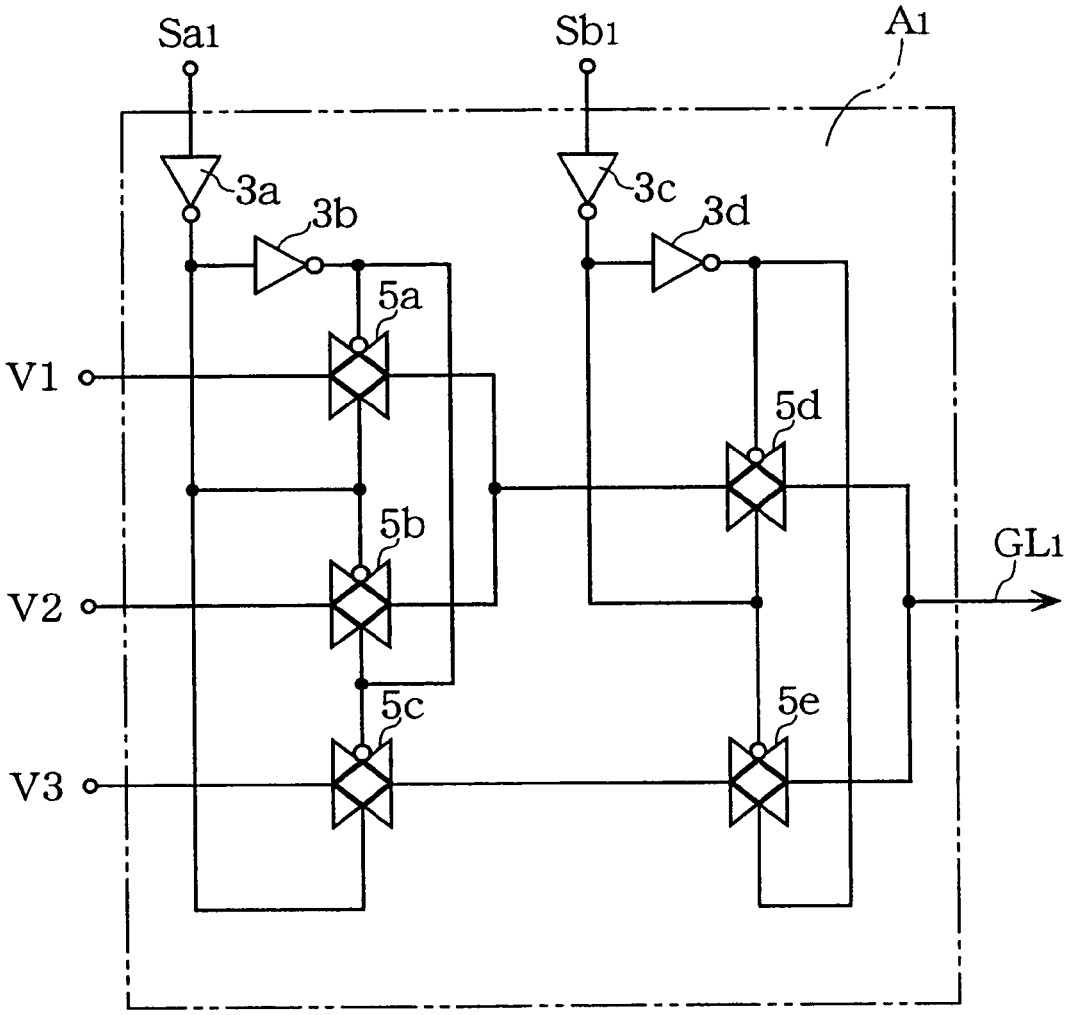
FIG. 3 is a circuit diagram showing the configuration of a selector circuit A1.

FIG. 2 is a block diagram showing the configuration of the gate line driver circuit, and FIG. 3 is a circuit diagram showing the configuration of a part of the gate line driver circuit. The gate line driver circuit 4 includes selector circuits A1, A2, . . . (reference symbol A will be used when collectively referring to the selector circuits) that correspond to the gate lines GL1, GL2, . . . To the selector circuit A, three input signals V1, V2, and V3 with different voltage levels are input. In addition, to the selector circuit A, two select signals Sa and Sb (reference symbols Sa and Sb will be used when collectively referring to the select signals, and subscripts will be appended to reference symbols Sa and Sb when individually referring to the select signals; for example, in the case of a select signal related to the selector circuit A1, reference symbols Sa1 and Sb1 will be used.) are input. By the combination of the logic values of the select signals Sa and Sb, any of the three input signals V1, V2, and V3 is selected and output to the gate line GL.

It is to be noted that the select signals Sa and Sb are produced by an external controller (not shown in the figure) and supplied to the gate line driver circuit 4.

The specific configuration of the selector circuit A1 is shown in FIG. 3. Specifically, the selector circuit Al includes four inverters 3*a*, 3*b*, 3*c*, and 3*d* and five transfer gates 5*a*, 5*b*, 5*c*, 5*d*, and 5*e*.

Next, the operation of the selector circuit A1 is described. For example, when the select signals Sa1 and Sb1 are both logic "0," V1 is selected and output to the gate line GL1. The circuit operation is briefly described below. When Sa1 is logic "0," the transfer gates 5*a* and 5*c* are set to the ON state and the transfer gate 5*b* is set to the OFF state. Therefore, to the transfer gate 5*d* V1 is input, and to the transfer gate 5*e* V3 is input. On the other hand, because Sb1 is logic "0," the transfer gate 5*d* is set to the ON state and the transfer gate 5*e* is set to the OFF state. Accordingly, of V1 and V3, V1 is selected and output to the gate line GL1.

Based on the same operation as that described above, when the select signal Sa1 is logic "0" and the select signal Sb1 is logic "1," V2 is selected and output to the gate line GL1. When the select signal Sa1 is logic "1" and the select signal Sb1 is logic "0," V3 is selected and output to the gate line GL1.

In this manner, the selector circuit A1 selects any of V1 to V3, according to the logic values of the select signals Sa1 and Sb1, and outputs the selected signal to the gate line GL.

The rest of the selector circuits A2, . . . other than the selector circuit A1 have the same configuration as the selector circuit A1, and thus select, in the same manner as that of the selector circuit A1, any of V1 to V3, according to the combination of the logic values of the select signals Sa2 and Sb2; Sa3 and Sb3; . . . , and output the selected signal to the gate lines GL2, GL3, . . .

The gate line driver circuit 4 is thus configured to select any of V1 to V3 and outputs the selected signal to the gate line GL.

In Embodiment 1, V1 is set to a voltage level to turn on the switching transistor Tr1, and V2 is set to a voltage level to turn off the switching transistor Tr1. That is, V1 and V2 are equivalent to conventional scan signals. V3 is set to a voltage level for a blanking signal.

Figure 4:
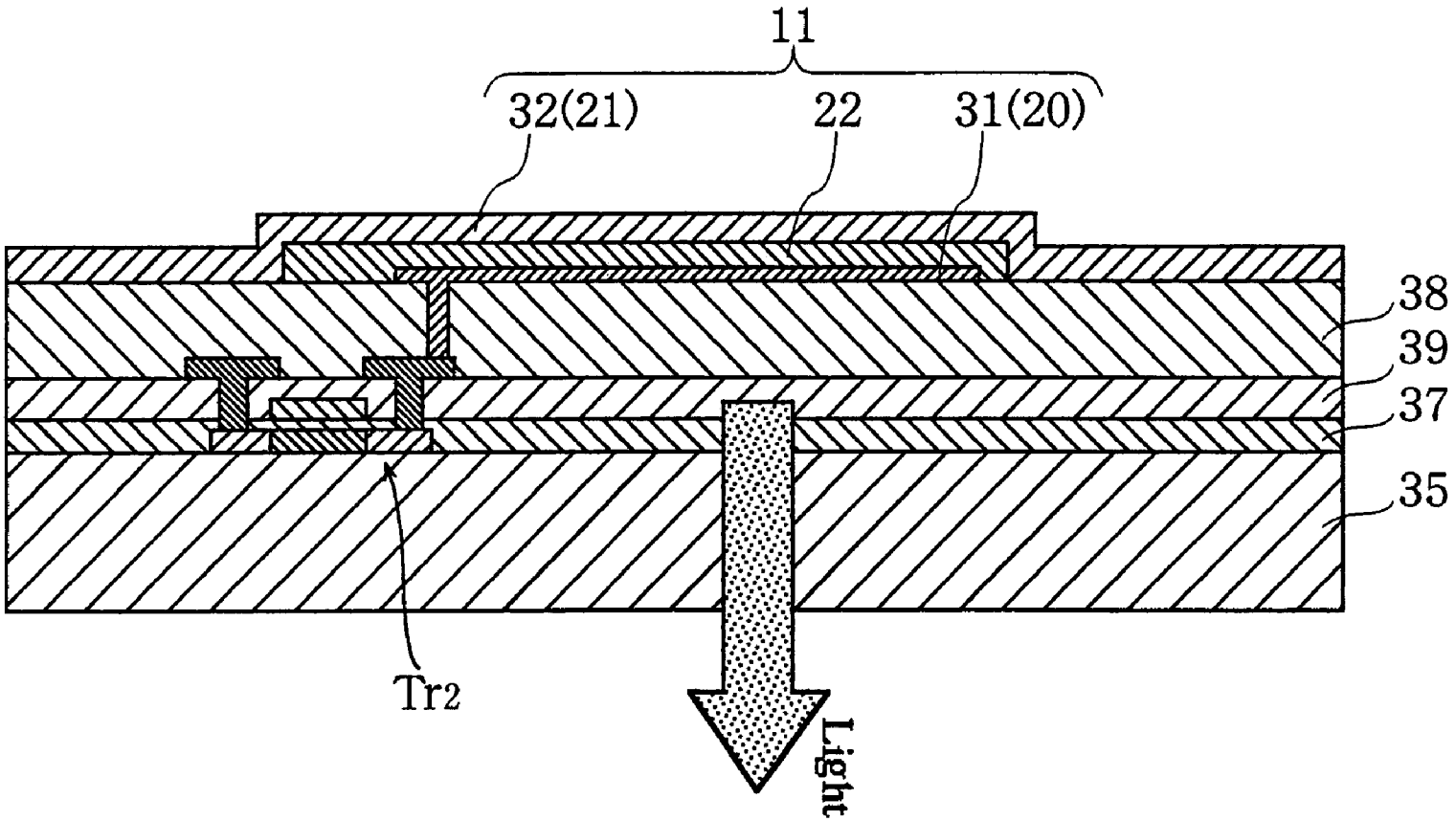
FIG. 4 is a cross-sectional view showing the configuration of a pixel of the EL display device according to Embodiment 1.
Figure 5:
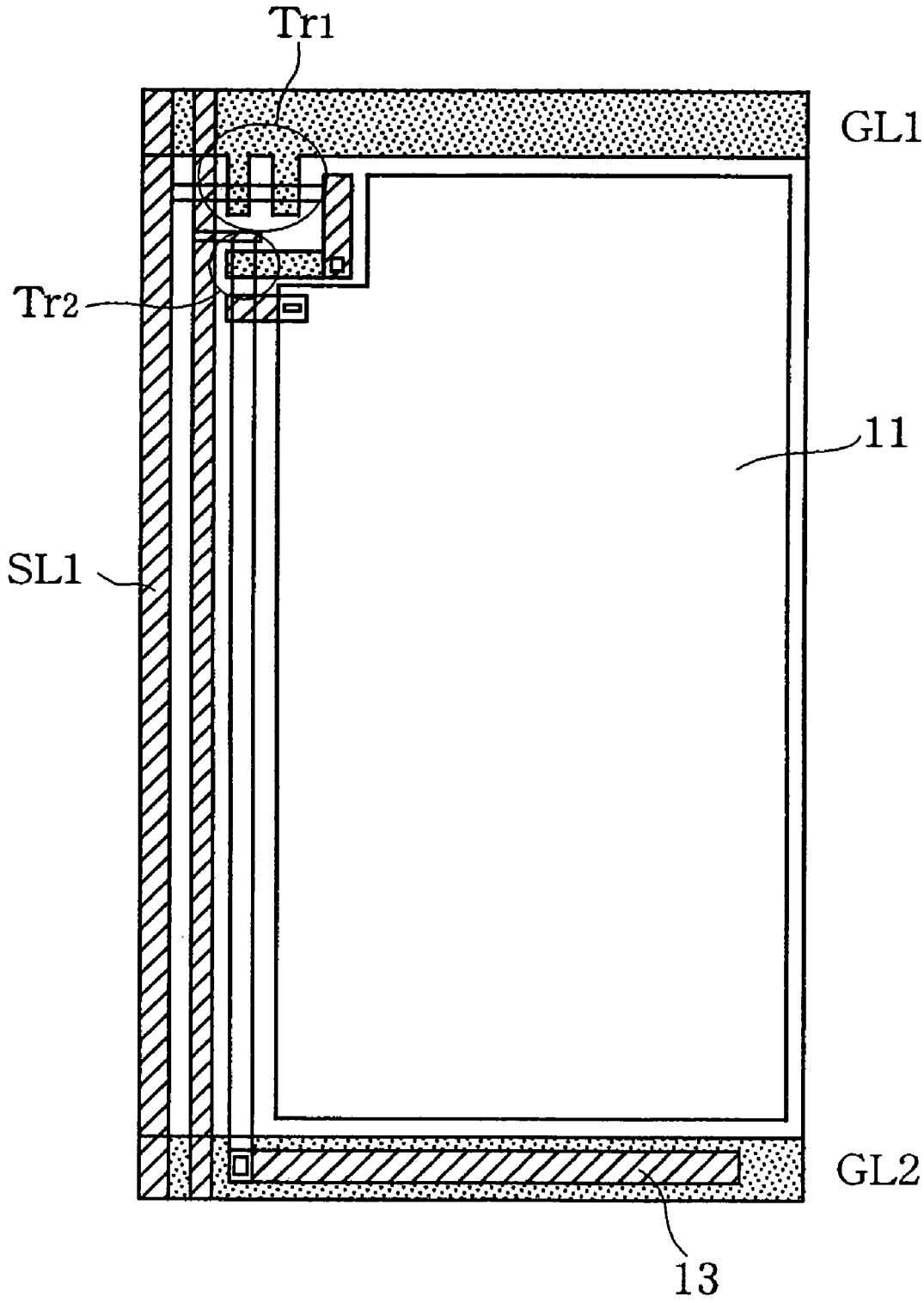
FIG. 5 is a plane view showing the configuration of the pixel of the EL display device according to Embodiment 1.

FIG. 4 is a cross-sectional view showing the configuration of a pixel, and FIG. 5 is a plane view showing the configuration of the pixel. An EL element 11 includes, as is shown in FIG. 4, an anode electrode 31 (which corresponds to a pixel electrode 20 in the present embodiment), a cathode electrode 32 (which corresponds to a counter electrode 21 in the present embodiment), and an EL layer 22 disposed between the anode electrode 31 and the cathode electrode 32. In FIG. 4, reference numeral 35 indicates a glass substrate, reference numeral 37 indicates a gate insulating film, reference numeral 38 indicates a planarizing film, and reference numeral 39 indicates an interlayer insulating film.

In addition, in FIG. 4, the anode electrode 31 is a transparent electrode of indium tin oxide (ITO) or the like, and the cathode electrode 32 is an opaque electrode (which is a metal electrode made of Mg, A1, or the like, or alloys of these metals and Ag, Li, and the like). Thus, light from the EL layer 22 is irradiated from the side of the glass substrate 35. The EL element 11 may be an organic EL element or an inorganic EL element, and may include a charge injection layer or a charge transport layer. That is, the configuration of the EL element is not limited to the one shown in FIG. 4; it is possible to use known EL elements. For the substrate 35, any material can be used as long as the substrate can support EL elements, and thus it is possible to use, in addition to a glass, a transparent substrate such as a resin film such as polycarbonate, polymethylmethacrylate, or polyethylene-terephthalate.

Figures 6, 6A:
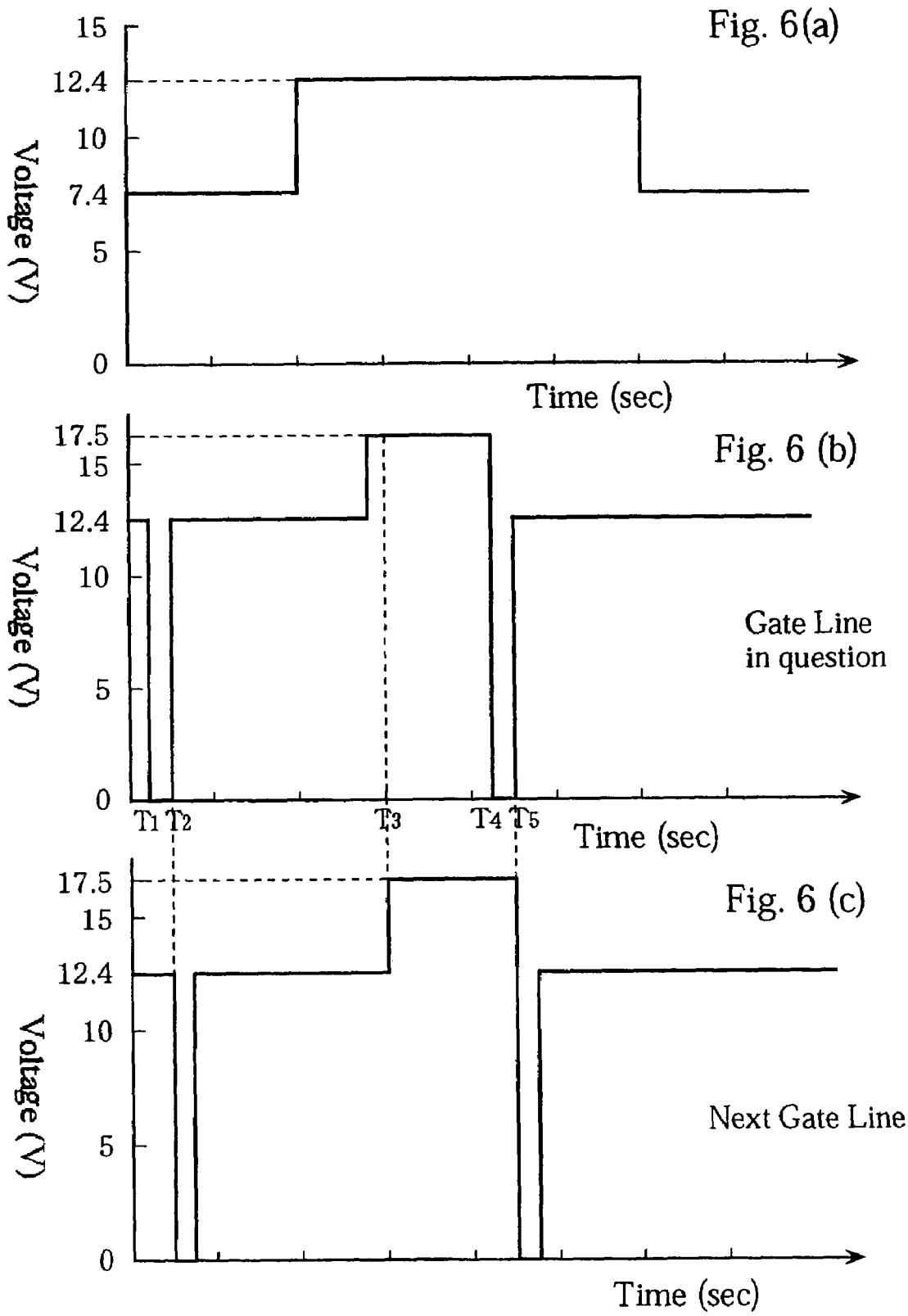
FIGS. 6(*a*) to 6(*c*) are timing charts of light-emission operation of the EL display device according to Embodiment 1.
Figure 7:
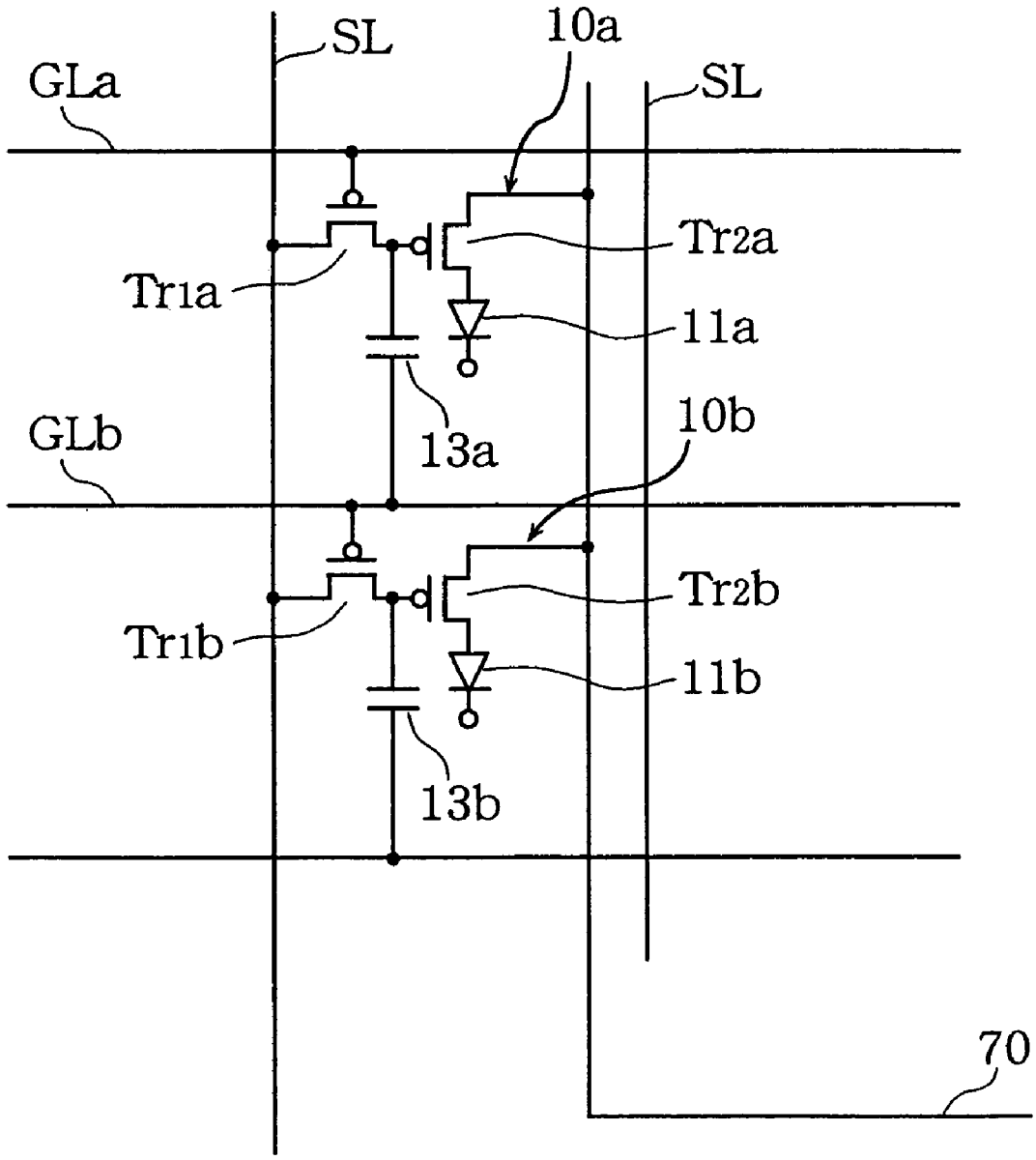
FIG. 7 is a configuration view of vertically adjacent pixels 10*a* and 10*b* for illustrating light-emission operation of EL elements in Embodiment 1.

Next, the display-operation of an EL display device having the above configuration is described. FIGS. 6(*a*) to 6(*c*) are timing charts of light-emission operation of an EL element. FIG. 6(*a*) is a waveform diagram of an image signal voltage, FIG. 6(*b*) is a waveform diagram of the voltage of the gate line GLa, and FIG. 6(*c*) is a waveform diagram of the voltage of the gate line GLb. Here, for convenience of description, the description is made using, as an example, two vertically adjacent pixels 10*a* and 10*b*, shown in FIG. 7. In FIG. 7, the subscript a is appended to the constitutional elements related to the pixel 10*a* (for example, the gate line is referred to as reference symbol GLa and the switching transistor is referred to as Tr1*a*, etc.), and the subscript b is appended to the constitutional elements related to the pixel 10*b* (for example, the gate line is referred to as reference symbol GLb and the switching transistor is referred to as Tr1*b*, etc.). In Embodiment 1, it is assumed that the potential of the counter electrode is set to 7.4 V and the potential of the current-supplying line 70 is set to 12.4 V. In addition, the image signal has two voltage levels, 5 V and 12.4. V; the voltage of 5 V indicates a light-emitting state and the voltage of 12.4 V indicates a non-light-emitting state.

First, as shown in FIG. 6(*b*), at time T1, the gate line GLa in question is switched from level V2 (which is 12.4 V in Embodiment 1) to level V1 (which is 0 V in Embodiment 1), and thus the pixel 10*a* is selected. Thereby, the switching transistor Tr1*a*, a P-channel transistor, goes into the ON state. With the transistor Tr1*a* being in the ON state, an image signal voltage (7.4 V) is applied, via the source line SL, to the gate of the driver transistor Tr2*a* and the auxiliary capacitor 13*a*. Namely, the period from time T1 to time T2 corresponds to the write period of an image signal. Here, since the potential of the current-supplying line 70 is set to 12.4 V, a voltage of −5 V (=7.4−12.4) is applied between the gate and source of the driver transistor Tr2*a*. Thereby, the driver transistor Tr2*a* is turned on, and current flows from the anode electrode (pixel electrode) of the EL element 11*a* to the cathode electrode (counter electrode) via the current-supplying line 70 and the driver transistor Tr2*a*, whereby the EL element 11*a* emits light.

Then, the voltage written to the gate electrode of the driver transistor Tr2*a* is held, and the EL element 11*a* continues to emit light at a given driving current. At time T3, which is within a hold time in which the voltage written to the gate electrode of the driver transistor Tr2*a* is held, a blanking signal is provided to the auxiliary capacitor 13*a* via the next gate line GLb. Specifically, at time T3, the next gate line GLb turns out to have the blanking signal voltage V3 (which is 17.5 V in the present embodiment). Thereby, since the gate electrode of the driver transistor Tr2*a* has capacitive coupling to the next gate line GLb, the gate potential of the driver transistor Tr2*a* increases by a potential of about 5 V. Accordingly, the potential between the gate and source of the driver transistor Tr2*a* becomes approximately 0, and the driver transistor Tr2 is turned off, whereby the light emission of the EL element 11*a* stops. It is to be noted that the auxiliary capacitor 13 is assumed to have a sufficiently large capacitance value with respect to the gate capacitor of the driver transistor Tr2. If the auxiliary capacitor does not have such a value, even if a blanking signal is supplied, the gate potential of the driver transistor Tr2*a* does not change much and the driver transistor Tr2*a* cannot be turned off.

In this manner, at time T3, which is within a hold time in which the voltage written to the gate electrode of the driver transistor Tr2*a* is held, a blanking signal is output via the gate line GLb, whereby the light emission of the EL element 11*a* is forcibly stopped.

In the above example, the light emission of the EL element was completely stopped by the blanking signal voltage provided to the gate of the transistor Tr2*a*; however, it is also possible to make light emission dim (for example, such brightness as to have a brightness level of less than about 1%) instead of quenching where light emission is stopped. In addition, because the EL element has a fast response of μs order, even with a blanking signal having a pulse width of ms order (T3 to T4), blanking of the EL element can be performed.

Subsequently, when the gate line GLa is selected at time T4, an image signal voltage is written in the same manner as that described above. At this point, because a voltage of 12.4 V (which is a signal voltage indicating a non-light-emitting state) is written to the image signal voltage, the driver transistor Tr2*a* goes into the OFF state and the EL element stops emitting light, whereby the non-light-emitting state is maintained until the present frame period. The non-light-emitting state at this point is not based on the blanking signal but on the image data. In this manner, the pixel 10*a* is driven to emit light in response to the image signal, and a blanking state is obtained in one frame period.

In the above example, the light-emission operation of the pixel 10*a* was described, but the other pixels also perform the same operation; an EL element in each pixel emits light in response to an image signal and a desired image is displayed, and a blanking period, where the EL elements do not emit light, is inserted in one frame. Accordingly, when displaying a moving image, a black display is inserted between an image of the previous frame and an image of the present frame, whereby an after-image phenomenon is suppressed, making it possible to perceive the image clearly.

For the driver transistor Tr2, it is also possible to use an N-channel transistor, but it is desirable to use a P-channel transistor such as one used in the present embodiment. This is because when the driver transistor Tr2 is formed with an N-channel transistor, the gate voltage for turning the driver transistor Tr2 into the ON state needs to be higher than the voltage of the anode of the EL element, increasing the voltage necessary to drive an active matrix type EL element.

Embodiment 2

Figure 8:
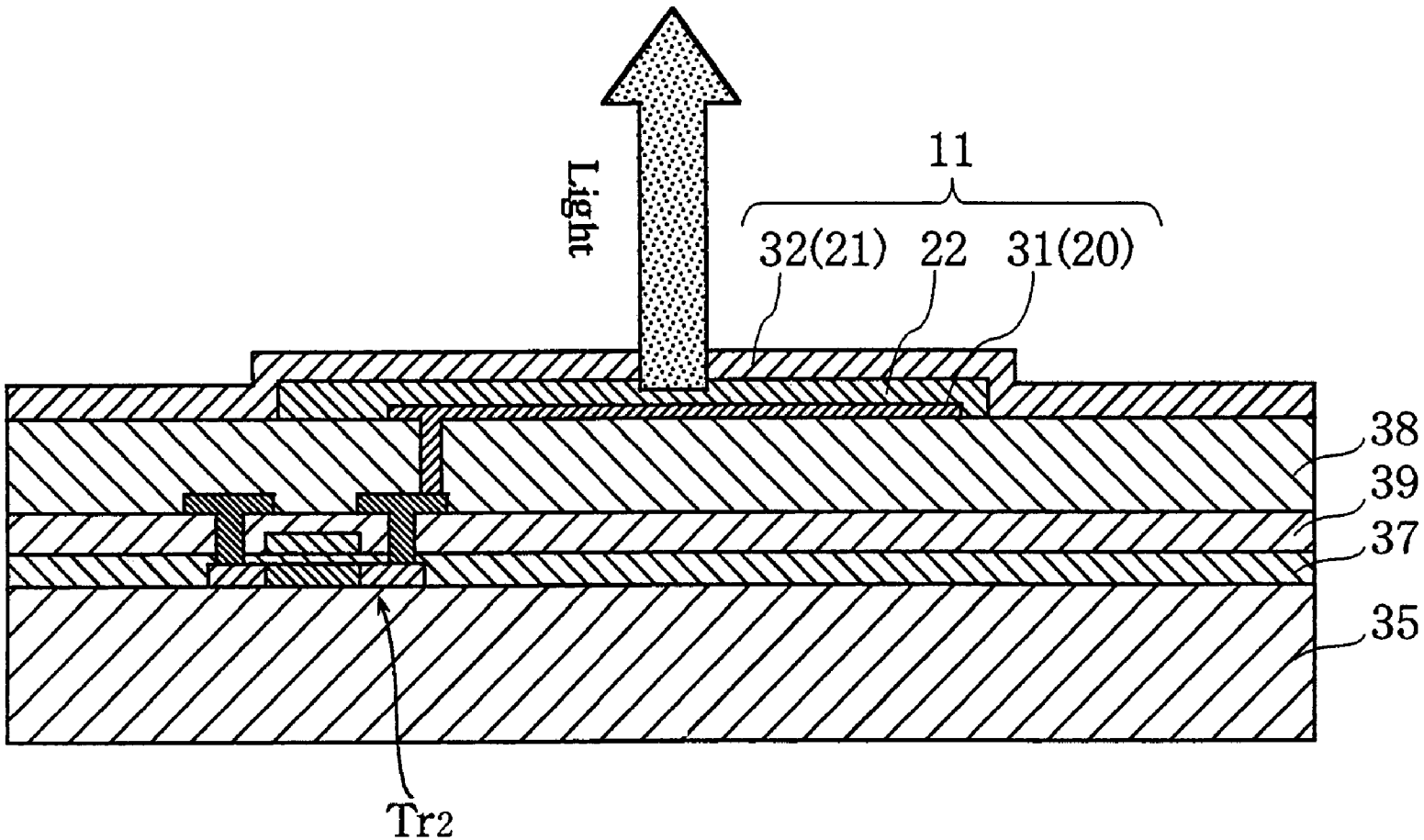
FIG. 8 is a cross-sectional view showing the configuration of a pixel of an EL display device according to Embodiment 2.

FIG. 8 is a cross-sectional view showing the configuration of a pixel of an active matrix type EL display device according to Embodiment 2. Embodiment 2 is characterized in that transistors Tr1 and Tr2 are both N-channel transistors and that a cathode electrode of an EL element serves as a pixel electrode and an anode electrode serves as a counter electrode, except for which the configuration is the same as that of the foregoing Embodiment 1. In Embodiment 2, the cathode electrode is an opaque electrode and the anode electrode is an ITO electrode. With such a configuration, light from a light-emitting layer is irradiated from the other side from a substrate 35. Thus, in Embodiment 2, the substrate 35 does not necessarily need to be a transparent substrate, as in Embodiment 1, and it is possible to use an opaque substrate such as silicon.

In the case where the cathode electrode of the EL element serves as a pixel electrode and the anode electrode serves as a counter electrode, the driver transistor Tr2 may be a P-channel transistor, but it is desirable to use an N-channel transistor in terms of reducing voltage. The display operation of the active matrix type EL display device according to Embodiment 2 is the same as that described in the foregoing Embodiment 1; the EL element emits light in response to an image signal and a desired image is displayed, and a blanking period is inserted.

Figure 9:
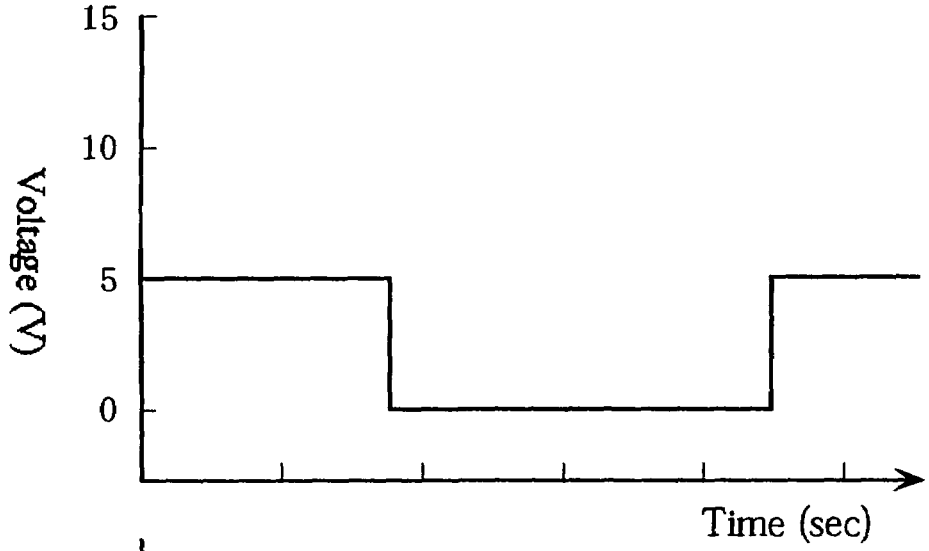
FIGS. 9(*a*) to 9(*c*) are timing charts of light-emission operation of the EL display device according to Embodiment 2.
Figure 9:
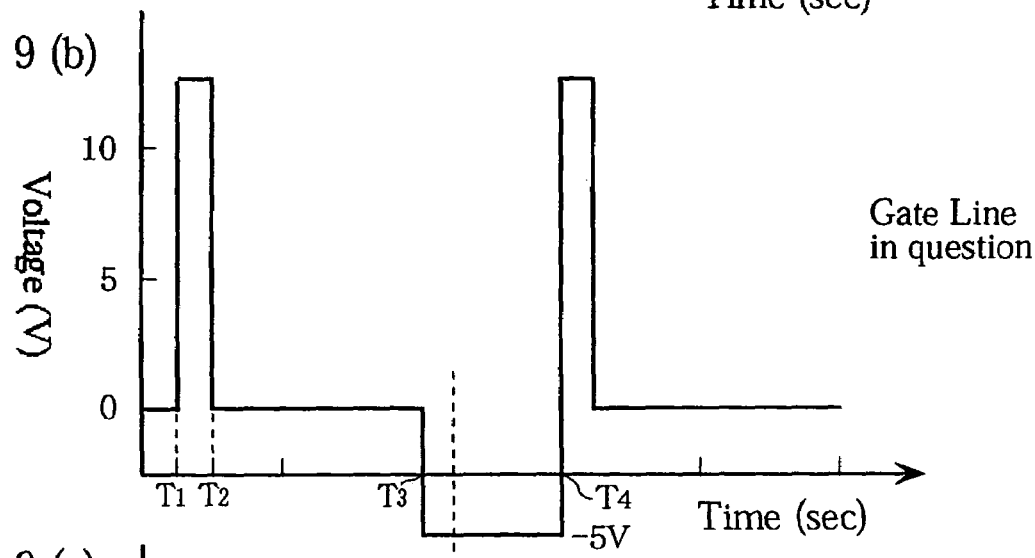
Figure 9:
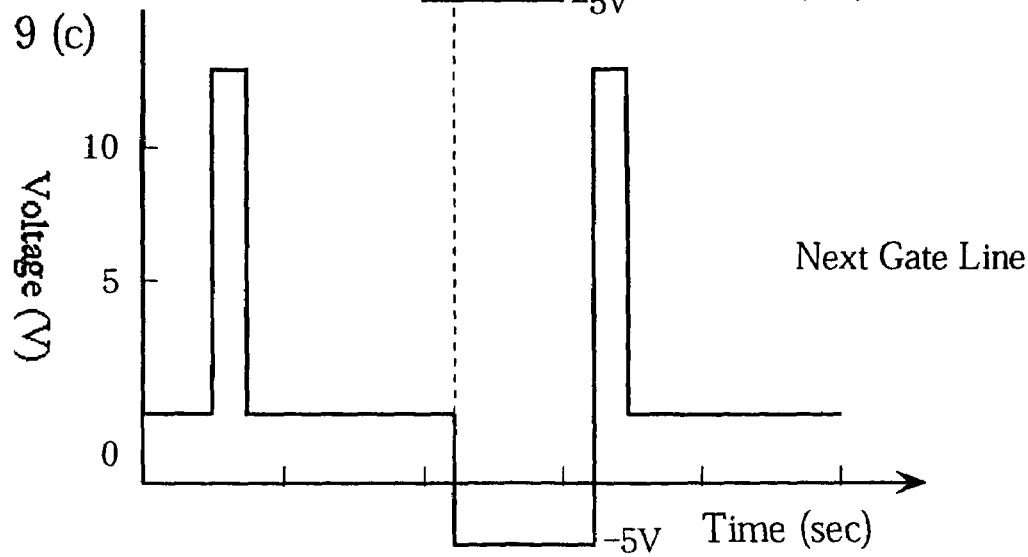
Figure 10:
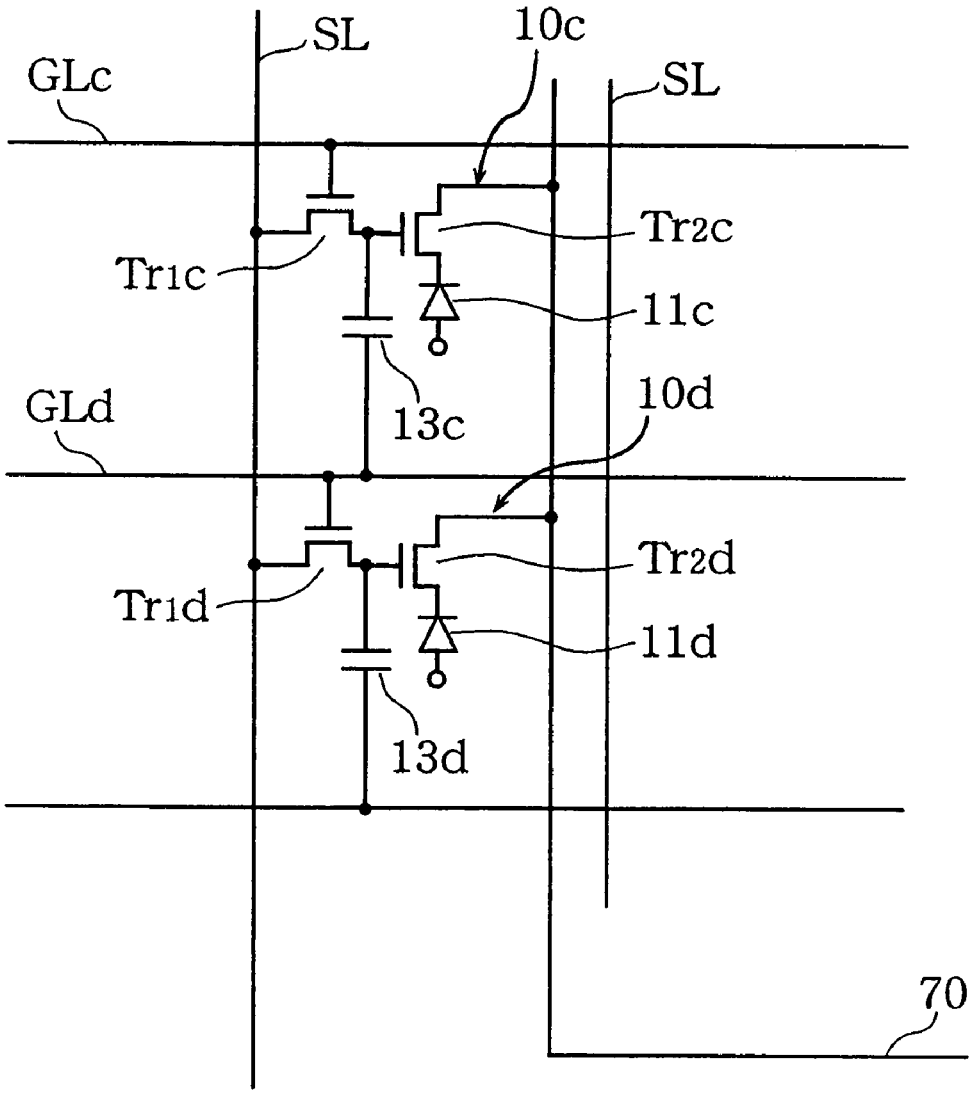
FIG. 10 is a configuration view of vertically adjacent pixels 10*c* and 10*d* for illustrating light-emission operation of EL elements in Embodiment 2.

FIGS. 9(*a*) to 9(*c*) are timing charts of light-emission operation of the EL display device according to Embodiment 2. FIG. 9(*a*) is a waveform diagram of an image signal voltage, FIG. 9(*b*) is a waveform diagram of the voltage of a gate line GLc, and FIG. 9(*c*) is a waveform diagram of the voltage of a gate line GLd. Here, the description is made using, as an example, two vertically adjacent pixels 10*c* and 10*d*, shown in FIG. 10. In FIG. 10, the subscript c is appended to the-constitutional elements-related to the pixel 10*c* (for example, the gate line is referred to as reference symbol GLc and the switching transistor is referred to as Tr1*c*, etc.), and the subscript d is appended to the constitutional elements related to the pixel 10*d* (for example, the gate line is referred to as reference symbol GLd and the switching transistor is referred to as Tr1*d*, etc.).

First, as shown in FIG. 9(*b*), at time T1 the gate line GLc in question is switched from level V2 (which is 0 V in Embodiment 2) to level V1 (which is 12.5 V in Embodiment 2), and thus the pixel 10*c* is selected. Thereby, the switching transistor Tr1*c*, an N-channel transistor, goes into the ON state. With the N-channel transistor Tr1*c* being in the ON state, an image signal voltage (5.0 V) is applied, via the source line SL, to the gate of the N-channel driver transistor Tr2*c* and an auxiliary capacitor 13*c*. In Embodiment 2, the potential of a current-supplying line 70 is set to −5.0 V and the potential of the counter electrode is set to 0 V. Therefore, a voltage of approximately 5 V is applied between the gate and source of the driver transistor Tr2*c*, whereby the driver transistor Tr2*c* is turned on. Thereby, current flows from the anode electrode (counter electrode) to the cathode electrode (pixel electrode), whereby the EL element 11*c* emits light. This light-emitting state is maintained until the timing (time T3) where the next gate line GLd turns out to have the blanking signal voltage V3 (which is −5 V in the present embodiment). Since the gate electrode of the driver transistor Tr2*c* is connected to the next gate line GLd via the auxiliary capacitor 13*c*, at time T3 the gate potential of the driver transistor Tr2*c* decreases by a potential of about 5 V. Hence, the potential between the gate and source of the driver transistor Tr2*c* becomes 0 and the light emission of the EL element 11*c* stops. It is to be noted that the auxiliary capacitor 13 is assumed to have a sufficiently large capacitance value with respect to the gate capacitor of the driver transistor Tr2. If the auxiliary capacitor does not have such a value, even if a blanking signal is supplied, the gate potential of the driver transistor Tr2*c* does not change much and the driver transistor Tr2*c* cannot be turned off.

In the above example, the light emission and blanking of the EL element 11*c* were described, but EL elements other than the EL element 11*c* also obtain light emission and blanking by the same operation.

Thus, in Embodiment 2 too, a blanking period can be inserted in one frame, as in Embodiment 1, and thus an influence of after-image is eliminated, making it possible to perceive a clear image.

In the present invention, in the case where the pressure resistance of the entire system is permitted, the transistors Tr1 and Tr2 may be configured using transistors with different polarities.

Embodiment 3

Figure 11:
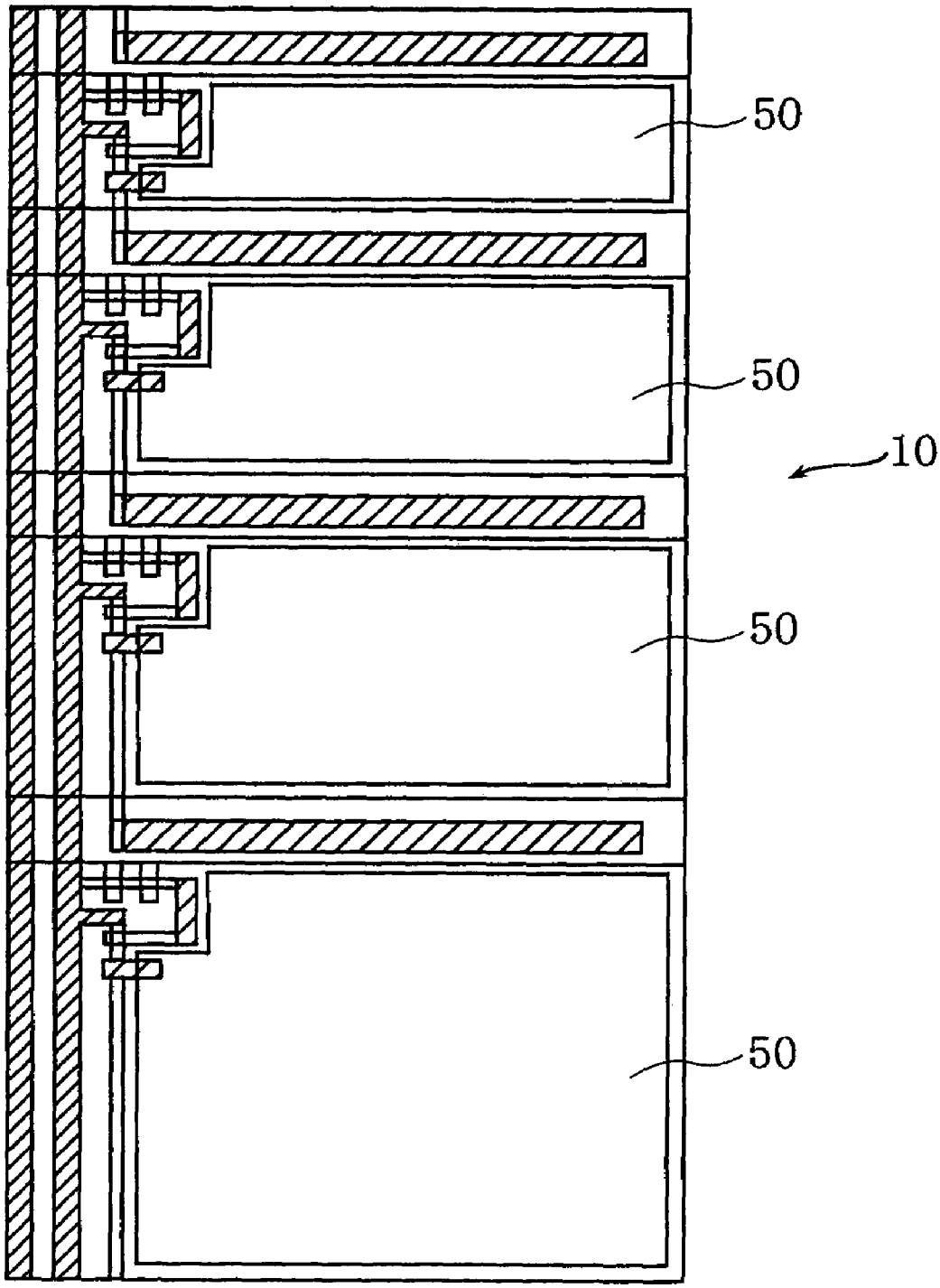
FIG. 11 is a plane view of a display portion of an EL display device according to Embodiment 3.
Figure 12:
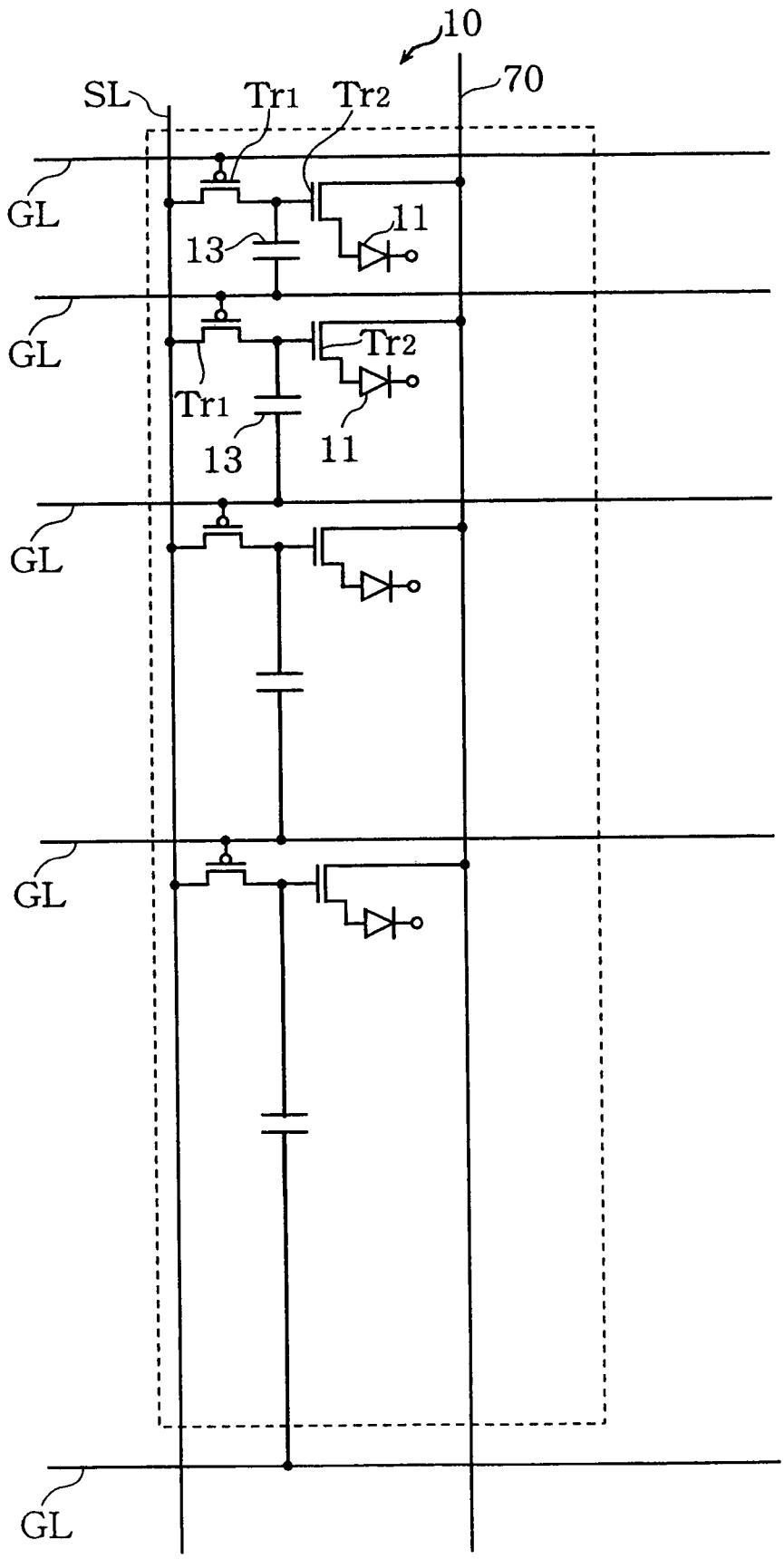
FIG. 12 is a circuit diagram of the display portion of the EL display device according to Embodiment 3.

FIG. 11 is a plane view of a display portion of a display device according to Embodiment 3, and FIG. 12 is a circuit diagram of the display portion. FIGS. 11 and 12 show only the configuration of a pixel. Embodiment 3 is characterized in that one unit pixel is split into a plurality of regions and that gray-scale display is provided by a spatial dithering method. The specific configuration is described below with reference to FIGS. 11 and 12.

A unit pixel 10 is structured such that it is split into a plurality of regions (four-regions in Embodiment 3). The configuration of sub-pixels 50, split regions, is the same as that of the unit pixel 10 in the foregoing Embodiment 1. Specifically, each of the sub-pixels 50 has a gate line GL, a switching transistor Tr1, a driver transistor Tr2, and an auxiliary capacitor 13.

Gray-scale display can be realized by the combination of light-emission and non-light-emission of the split sub-pixel regions. To the source line SL, a digital image signal is supplied.

Specifically, gray-scale display is provided by weighing the areas of light-emitting portions of EL elements 11 in the sub-pixels 50, a plurality of split regions, so as to correspond to bits. By thus weighting the area ratio of the light-emitting portions so as to correspond to bits such as $1:2:4:\ldots:2^{(n-1)}$, but not by dividing the area equally, it becomes possible to provide $2^n$-gray-scale display.

Figure 13:
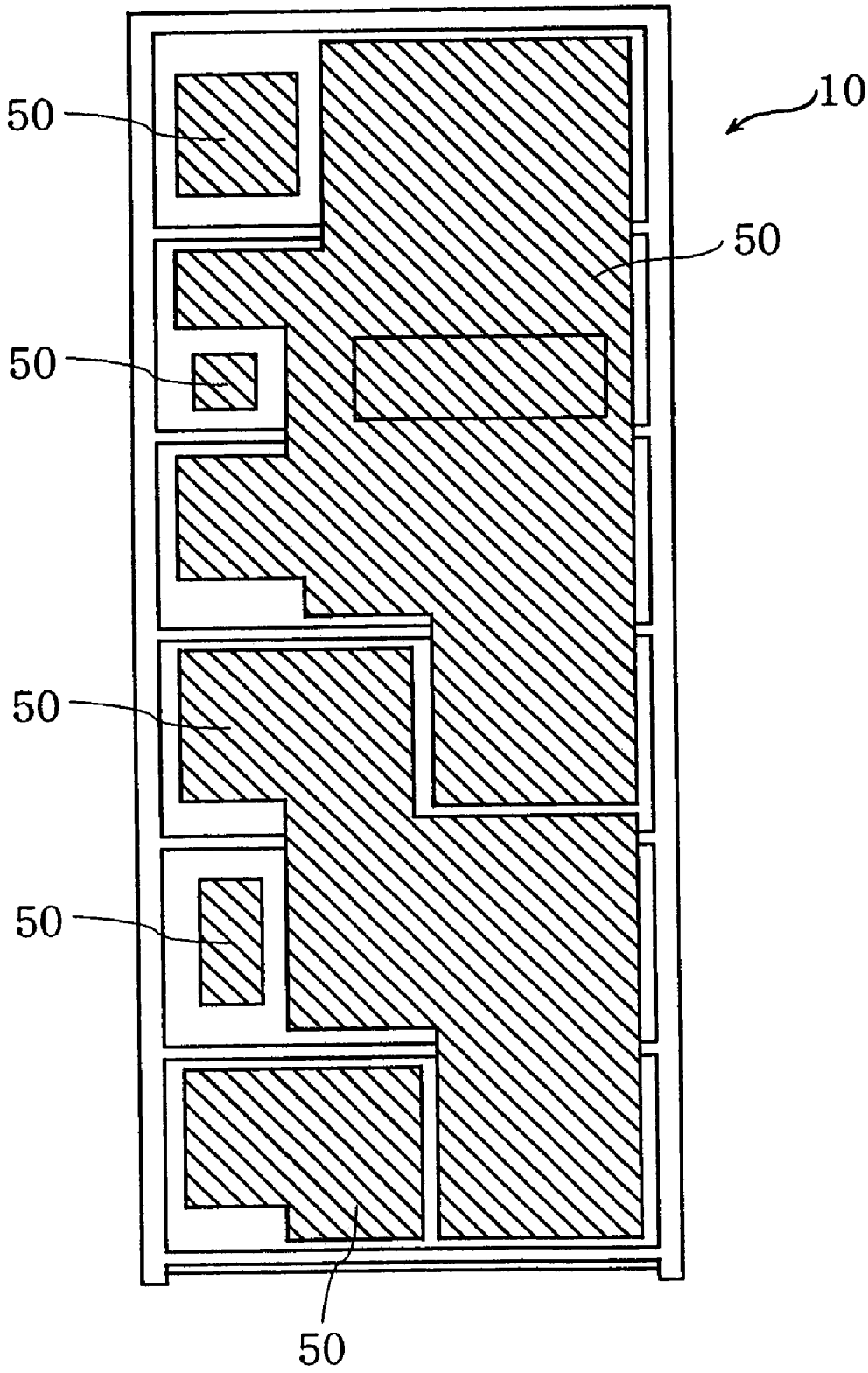
FIG. 13 is a plane view showing a modified example of the display portion of the EL display device according to Embodiment 3.

In an example shown in FIG. 11, 16-gray-scale display can be provided by 4-bit data. In addition, in a configuration, as shown in FIG. 13, in which six sub-pixels 50 are provided, 64-gray-scale display can be provided by 6-bit data. Needless to say, the electrode layout of the sub-pixels is not limited to those shown in FIGS. 11 and 13.

Since it is not necessary to provide lines dedicated to supplying blanking signals or transistors dedicated to blanking, as were required in the prior-art example, it is possible, in the present invention, to increase the aperture ratio of the pixels. In addition, the present invention having such a configuration is extremely effective for realizing an active matrix type EL display device with a uniform display and excellent gray-scale performance, by using, in particular, spatial dithering methods.

Embodiment 4

Embodiment 4 is characterized in that the display devices of the foregoing embodiments are driven under such operating conditions that the driver transistors Tr2 are operated in the linear region.

EL elements are current controlling light-emitting elements in which the brightness varies with currents flowing through the elements, and therefore, in order to eliminate display non-uniformity, the elements need to be driven at constant current. For methods of performing the constant current drive, a constant-current circuit may be provided in a pixel. The configuration in which a constant-current circuit is provided, however, increases the number of transistors, causing a reduction in yield. In Embodiment 4, the driver transistors are operated in the linear region, whereby the current value cannot be affected much even if variations occur in the threshold of the driver transistors or in the voltage applied to the gates of the driver transistors.

Figure 14:
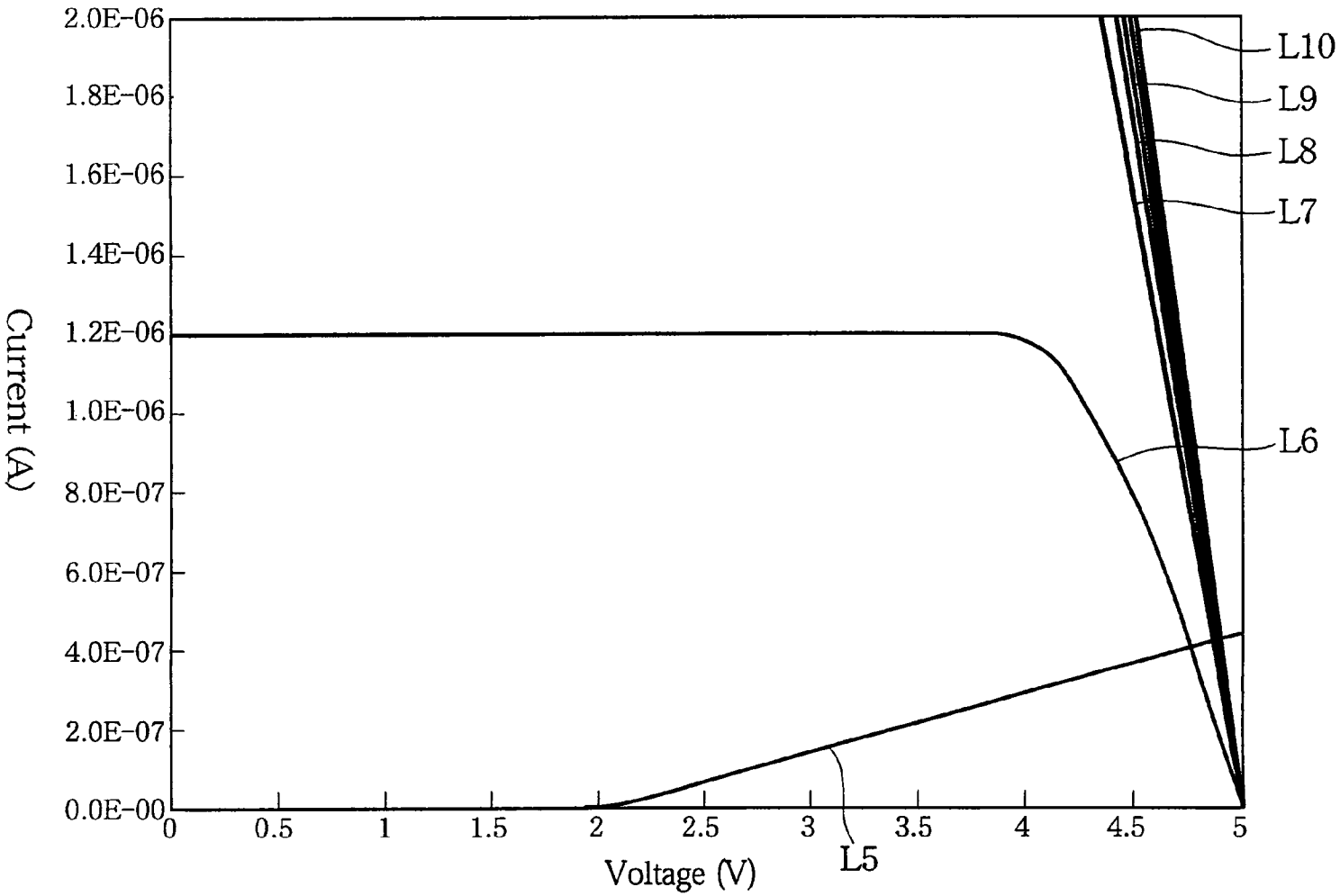
FIG. 14 is a simulation chart showing the results of an operating point analysis performed on the EL element and driver transistor of an EL display device according to Embodiment 4.

FIG. 14 shows the results of an operating point analysis performed on an EL element 11 and a driver transistor Tr2 (which is formed using a P-channel transistor). In FIG. 14, line L5 shows the voltage/current characteristics of the EL element 11 and lines L6 to L10 show the drain voltage/drain current characteristics of the driver transistor Tr2. As for the drain voltage/drain current characteristics, line L6 shows the case where the gate voltage is −1 V, line L7 shows the case where the gate voltage is −3 V, line L8 shows the case where the gate voltage is −4 V, line L9 shows the case where the gate voltage is −5 V, and line L10 shows the case where the gate voltage is −6 V. As is clear from FIG. 14, it can be seen that even when the gate voltage of the transistor is changed the current value at the point of intersection between the drain voltage/drain current characteristics of the driver transistor Tr2 and the voltage/current characteristics of the EL element 11 is not affected much. Hence, even transistors with bad characteristics such as those having been conventionally considered to be unusable can be used. This is advantageous condition particularly for the case where polysilicon is used for a transistor.

Embodiment 5

Figure 15:
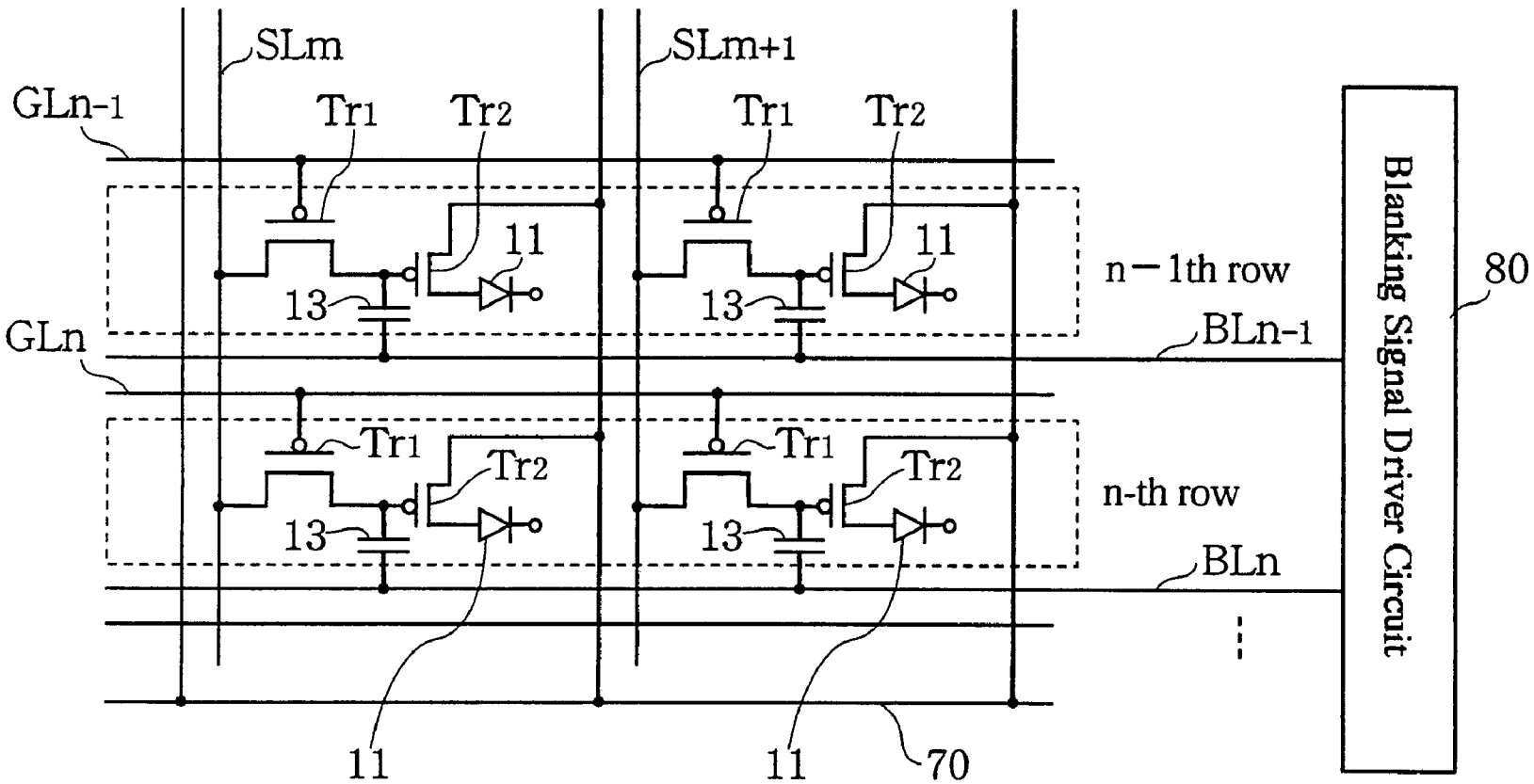
FIG. 15 is a circuit diagram of a display portion of an EL display device according to Embodiment 5.
Figure 16:
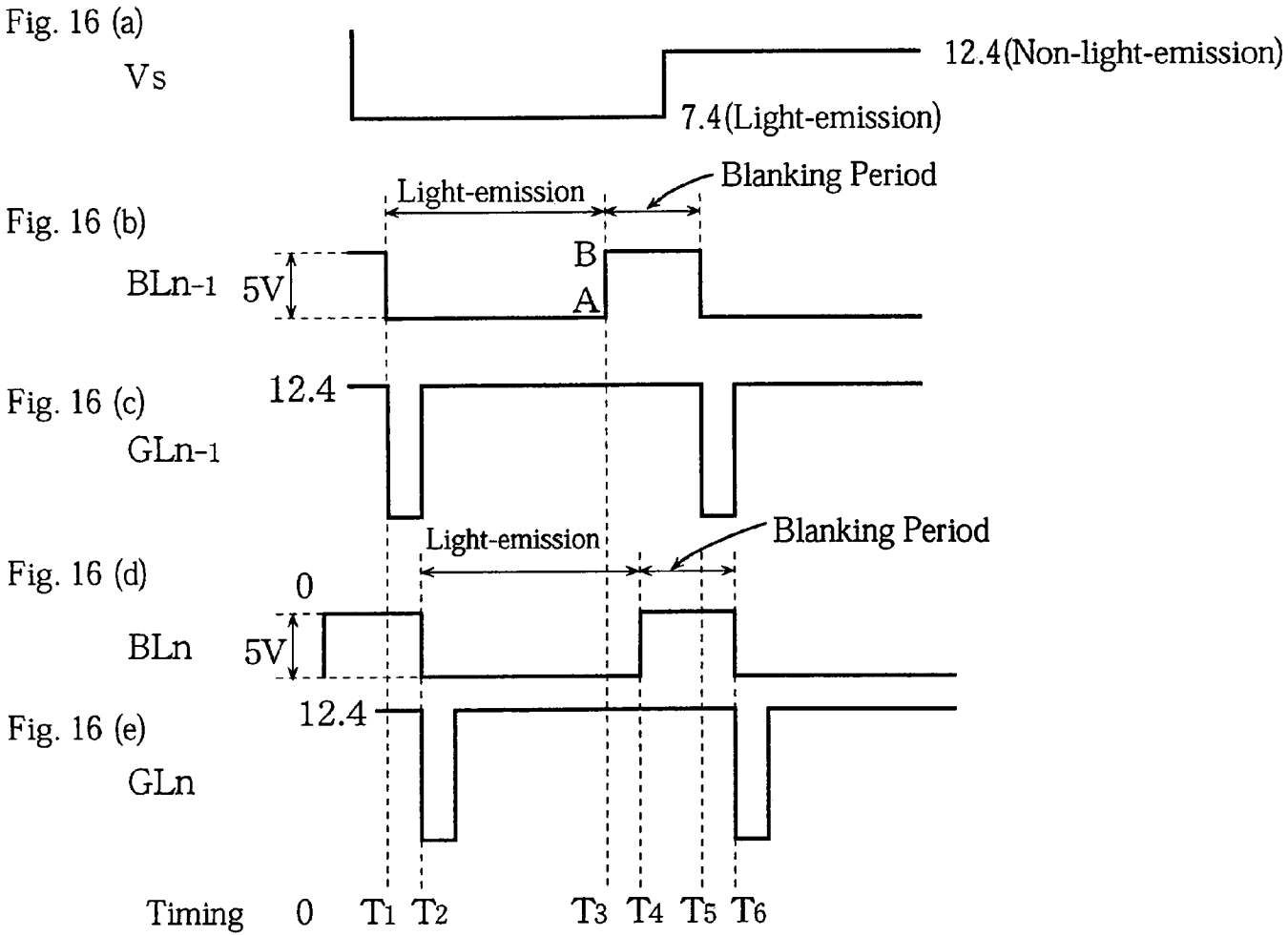
FIGS. 16(*a*) to 16(*e*) are timing charts of light-emission operation of the EL display device according to Embodiment 5.

FIG. 15 is a circuit diagram of an EL display device according to Embodiment 5, and FIGS. 16(*a*) to 16(*e*) are timing charts showing light-emission operation of the EL display device according to Embodiment 5. Embodiment 5 is similar to Embodiment 1, and thus like components are indicated by like reference numerals. In the foregoing Embodiment 1, the configuration is such that blanking signals are supplied from the gate line GL; on the other hand, in Embodiment 5 the configuration is such that lines dedicated to supplying blanking signals (blanking signal lines) are provided, and from which blanking signal are supplied.

FIG. 15 shows only four pixels related to a gate line GLn−1 of the n−1-th row, a gate line GLn of the n-th row, a source line SLm of the m-th column, and a source line SLm+1 of the m+1-th column, but other pixels also have the same configuration.

With reference to FIG. 15, the configuration of the present embodiment is described. Blanking signal lines are individually provided to each row. In FIG. 15, reference symbol BLn−1 indicates a blanking signal line for the n−1-th row and reference symbol BLn indicates a blanking signal line for the n-th row. The blanking signal line BLn−1 is connected to one of the electrodes of an auxiliary capacitor 13 in each pixel belonging to the n−1-th row. The blanking signal line BLn is connected to one of the electrodes of an auxiliary capacitor 13 in each pixel belonging to the n-th row. These blanking signal lines BLn−1 and BLn are commonly connected to a blanking signal driver circuit 80, and the blanking signal driver circuit 80 is configured so as to supply blanking signals with a given voltage at given timing via the blanking signal lines BLn−1 and BLn.

In the present embodiment, blanking signals are not supplied from the gate line GL; therefore, instead of the gate line driver circuit 4, a gate line driver circuit (for example, a gate line driver circuit 4A in Embodiment 7, as will be described later) which comprises a shift resistor and an output buffer, is used.

Next, the light-emission operation of an EL display device having the above-described configuration is described, with reference to FIGS. 16(*a*) to 16(*e*). Image signal voltage Vs supplied to the source lines SLm and SLm+1 has, as shown in FIG. 16(*a*), two voltage levels, 7.4 V and 12.4 V; the voltage of 7.4 V indicates a light-emitting state and the voltage of 12.4 V indicates a non-light-emitting state. The potential of a current-supplying line 70 is set to 12.4 V and the potential of the cathode electrodes of EL elements 11 is set to 0 V.

First, the light-emission operation of the pixels belonging to the n−1-th row is described. At time T1 the potential of the gate line GLn−1 changes, as shown in FIG. 16(*c*), from a high level (which corresponds to level V2 and is 12.5 V in the present embodiment) to a low level (which corresponds to level V1 and is 0 V in the present embodiment). Thereby, the switching transistors Tr1 connected to the gate line GLn−1 are turned on at the timing of time T1, whereby an image signal voltage (7.4 V) is applied to the gate electrodes of the driver transistors Tr2 via the source lines SLm and SLm+1. Here, since the potential of the current-supplying line 70 is 12.4 V and the potential of the cathode electrodes of the EL elements 11 is 0 V, a voltage of −5 is applied between the gate and source of the driver transistors Tr2. Accordingly, the driver transistors Tr2 are turned on and current flows from the current-supplying line 70 through the EL elements 11, whereby the EL elements 11 emit light. Because the auxiliary capacitors 13 are connected to the gate electrodes of the driver transistors Tr2, the gate voltage is held at 7.4 V.

Subsequently, at the timing of time T3, the potential of the blanking signal line BLn−1 is raised by 5 V (i.e., the potential corresponds to blanking signal voltage V3) (specifically, the potential is raised from point A to point B in FIG. 16(*b*)). Meanwhile, the auxiliary capacitors 13 have a sufficiently large capacitance value with respect to the gate capacitors of the driver transistors Tr2. Therefore, by an increase in the potential of the blanking signal line BLn−1 of 5 V, the potential of the gate electrodes of the driver transistors Tr2 increases by nearly 5 V. Thereby, the driver transistors Tr2 are turned off and the light emission stops. This state continues until the next write timing (time T5). Thus, the period from time T3 to time T5 becomes a blanking period for the pixels of the n−1-th row.

Similarly, for the pixels of the n-th row, the period from time T4 to time T6 becomes a blanking period.

Needless to say, the timing to provide blanking and the time width of the blanking can be provided arbitrarily, if necessary, so as to achieve maximum effects; for example, the output timing of blanking signals corresponding to each row may be adjusted so that the timing is the same or is different.

As described above, blanking signals can be applied, in the same period, to all the pixels belonging to one same row, while blanking signals can be applied to pixels in a column sequentially, one after the other, in a given time interval; accordingly, blanking operation can be performed more effectively.

Embodiment 6

Figure 17:
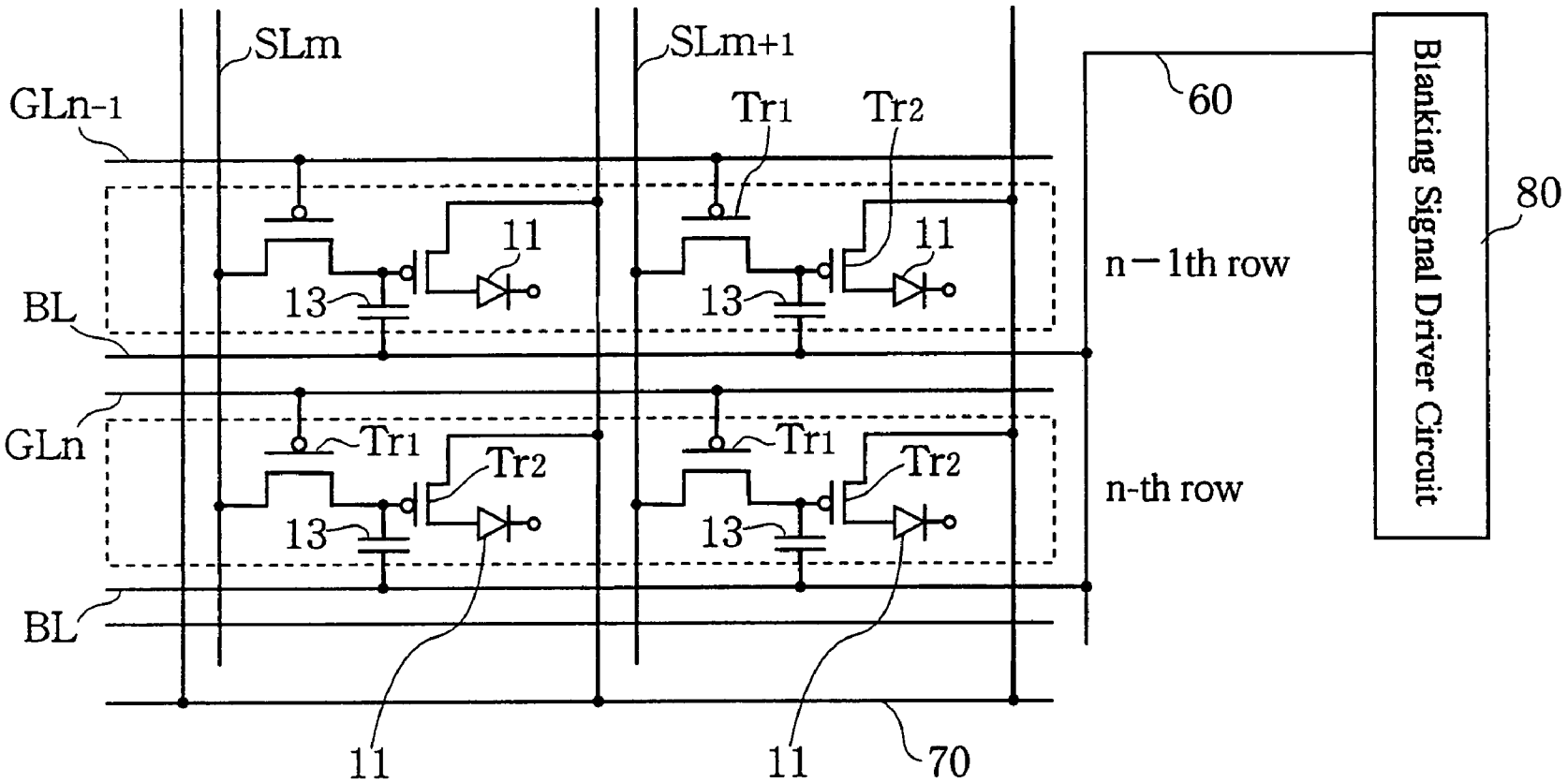
FIG. 17 is a circuit diagram of a display portion of an EL display device according to Embodiment 6.
Figure 18:
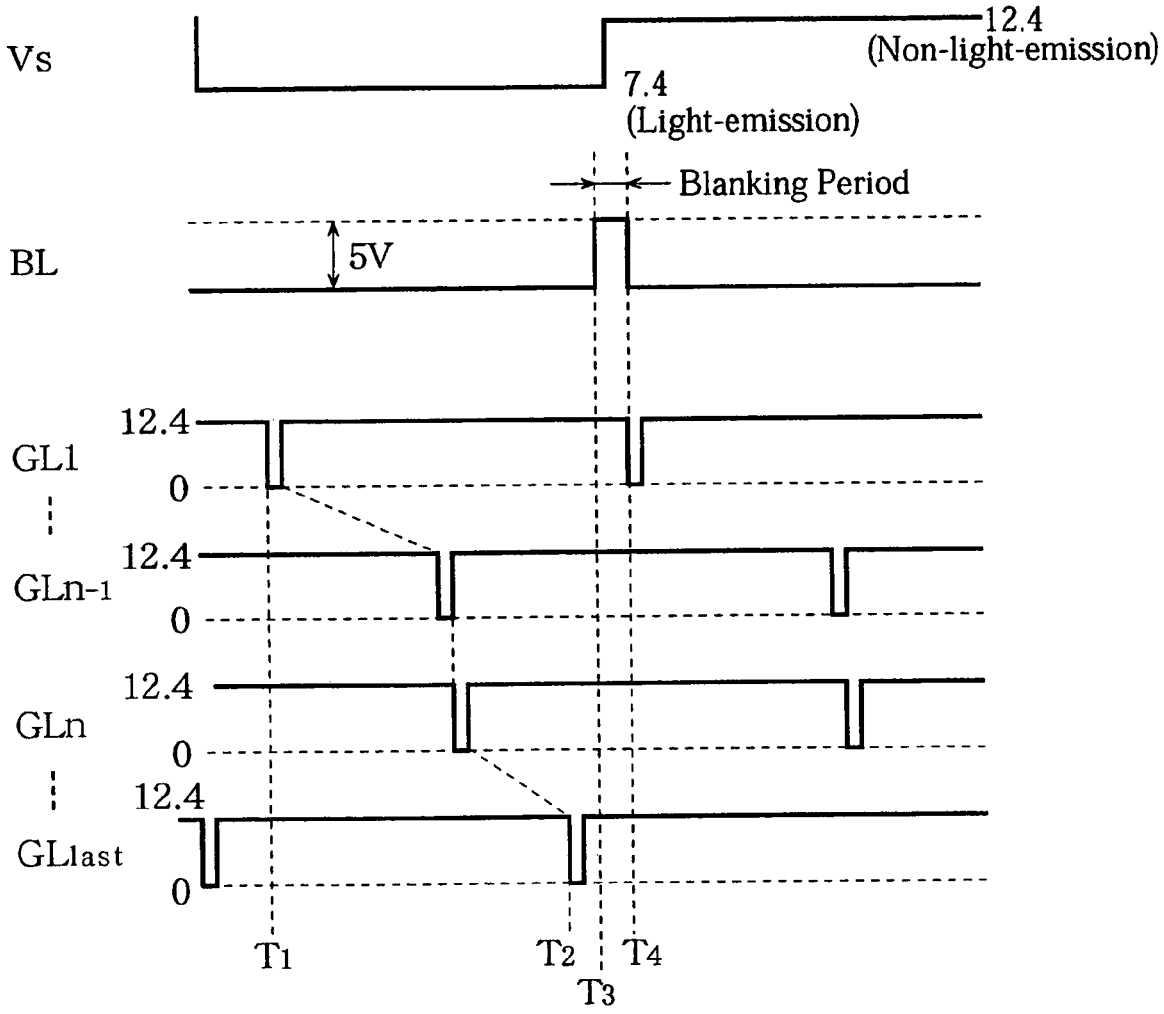
FIG. 18 is a timing chart of light-emission operation of the EL display device according to Embodiment 6.

FIG. 17 is a circuit diagram according to Embodiment 6, and FIG. 18 is a timing chart of light-emission operation. In Embodiment 6, blanking signal lines BL are provided as in the foregoing Embodiment 5 and the basic operation of producing light emission of EL elements 11 is the same as that in Embodiment 5. It is to be noted, however, that in Embodiment 5 the blanking signal lines are configured so as to be driven independently for each row, but in Embodiment 6 the blanking signal lines BL wired to each row are configured so as to be connected to a blanking signal driver circuit 80 via a common line 60. Therefore, the timing to provide blanking signals are the same for the pixels of all rows, that is, the timing is the same for all the pixels on the display.

With reference to FIG. 18, light-emission operation is described below. In the period from time T1 to time T2, gate lines GL1, GL2, . . . , GLn, . . . , GLlast (which means the gate line of the last row) are sequentially selected, and pixels of each row sequentially emit light. Then, at time 3, which is the time after the pixels belonging to the gate line GLlast have been selected, the potential of blanking signal line BL increases by 5 V. Thereby, the pixels belonging to all the rows stop emitting light at time T3. Namely, at time T3, the entire display goes black. Then, at time T4, the potential of the blanking signal line decreases by 5 V, returning to the initial low-level state. Thus, the blanking state is reset. That is, the period from time T3 to time T4 corresponds to a blanking period. Meanwhile, from time T4, the gate lines GL1, GL2, . . . , GLn, . . . , GLlast are sequentially selected again, whereby an image of the present frame is displayed.

In such a manner, after the time of selecting the last gate line, all the pixels go into a blanking state at the same timing and turns out to have the same blanking period. Accordingly, Embodiment 6 has an advantage over Embodiment 5 in that the configuration of the blanking signal driver circuit 80 can be simplified.

It is to be noted, however, that in the present embodiment because a blanking period is inserted in the period from the time the last gate line has been selected until a gate line of the first row is selected, the blanking period is shorter than that in Embodiment 5. However, it has been confirmed by experiments conducted by the present inventors that even with such a short period, due to the insertion of a blanking period, a clear image can be achieved.

Embodiment 7

Figure 19:
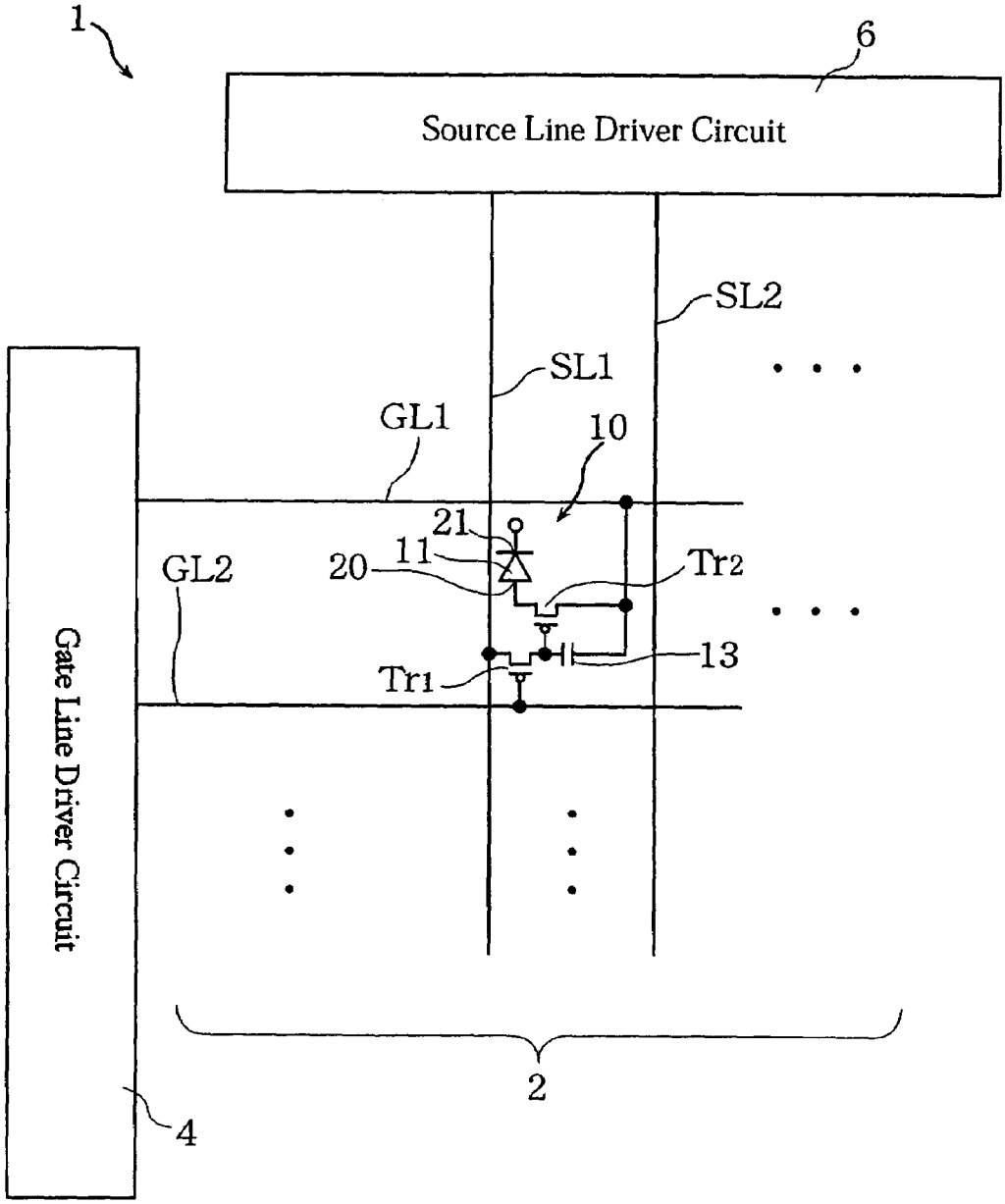
FIG. 19 is a circuit diagram showing the configuration of an active matrix type EL display device according to Embodiment 7.

FIG. 19 is a circuit diagram showing the configuration of an active matrix type EL display device according to Embodiment 7. Embodiment 7 is similar to the foregoing Embodiment 1, and thus like components are indicated by like reference numerals and a detailed description is omitted.

In the foregoing Embodiment 1, the current-supplying line 70 was provided, but in Embodiment 7, the current-supplying line 70 is omitted and the configuration is such that a driving current is supplied from gate line GL to EL elements 11. In addition, it is configured that blanking signals are provided to the EL elements directly from the gate line GL.

With reference to FIG. 19, the configuration of an EL display device according to Embodiment 7 is described below. In Embodiment 7, the gate electrode of a switching transistor Tr1 is connected to gate line GL, the source electrode of the switching transistor Tr1 is connected to source line SL, and the drain electrode of the switching transistor Tr1 is commonly connected to the gate of a driver transistor Tr2 and one of the electrodes of an auxiliary capacitor 13. The driver transistor Tr2 is configured such that the source electrode is commonly connected to an antecedent gate line 3, a designated gate line, and the other electrode of the auxiliary capacitor 13, and the drain electrode is connected to the anode electrode (which corresponds to a pixel electrode 20) of an EL element 11.

As described above, when the construction is such that a driving current is supplied to the EL element 11 from the antecedent gate line (which corresponds to the designated gate line), a current-supplying line can be omitted, achieving an improvement in aperture ratio; in addition, it is possible to prevent the occurrence of a short-circuit between the source line and the current-supplying line or between the gate line and the current-supplying line, which has been a problem of the prior art. It is to be noted that a connection line between the antecedent gate line and the EL element corresponds to a lead from the antecedent gate line, and is not a bus line such as a current-supplying line. Hence, the connection line has an extremely small line width compared to the current-supplying line, and therefore the area of the connection line with respect to the pixel is extremely small; consequently, the connection line does not contribute to a reduction in aperture ratio.

Figure 20:
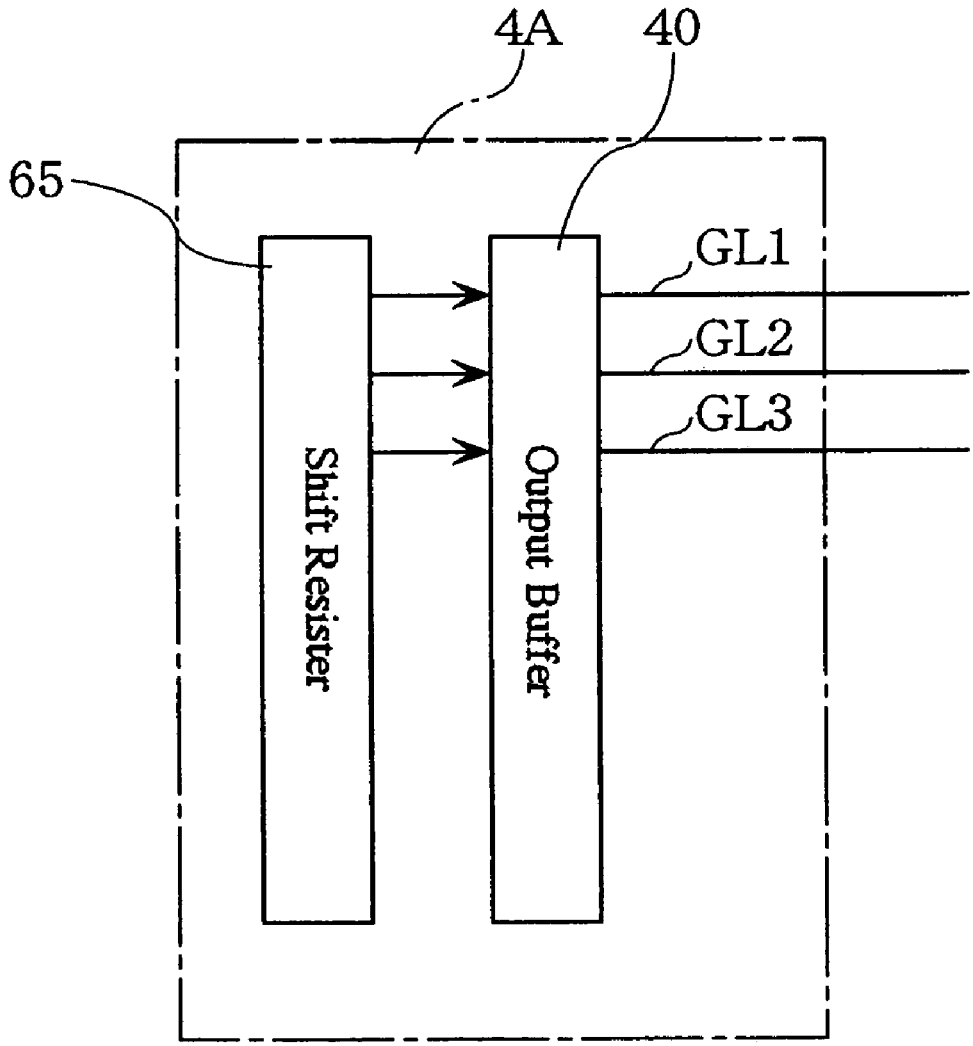
FIG. 20 is a circuit diagram showing the configuration of a gate line driver circuit 4A used in the active matrix type EL display device according to Embodiment 7.

In Embodiment 7, a gate line driver circuit 4A is used in place of the gate line driver circuit 4 in Embodiment 1. The gate line driver circuit 4A includes, as shown in FIG. 20, a shift resistor 65 and an output buffer 40, and is configured so as to selectively output two signal levels, a high and a low level.

Figure 21:
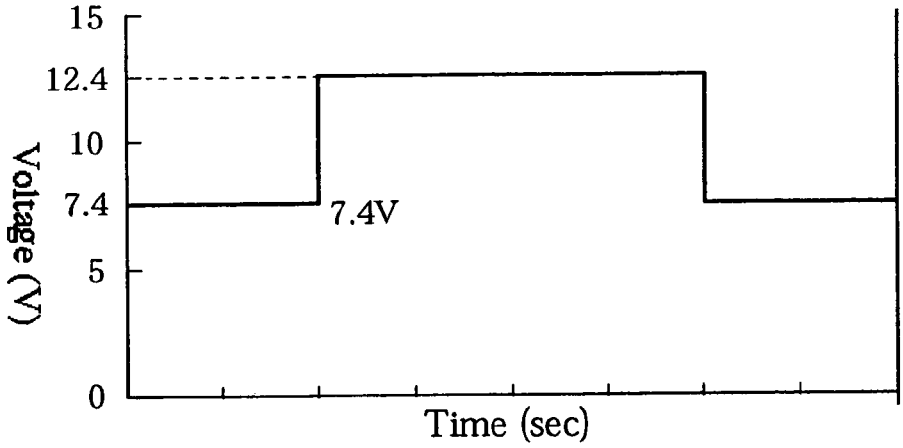
FIGS. 21(*a*) to 21(*c*) are timing charts of light-emission operation of an EL element in Embodiment 7.
Figure 21:
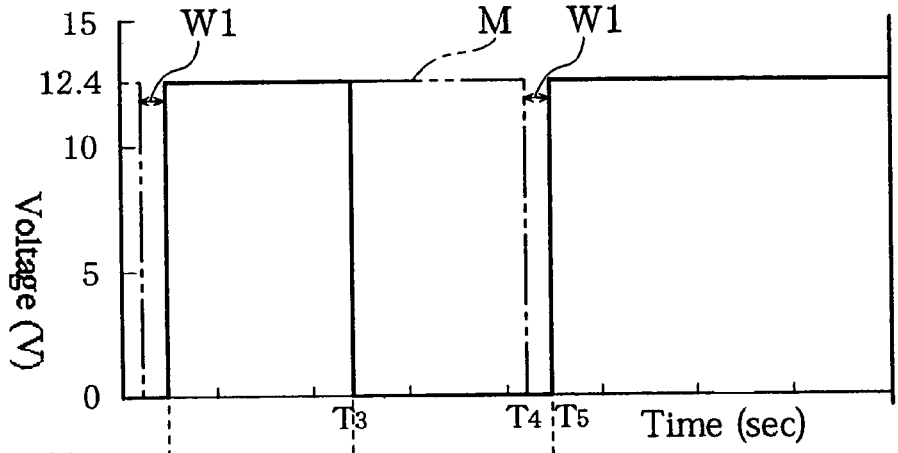
Figure 21:
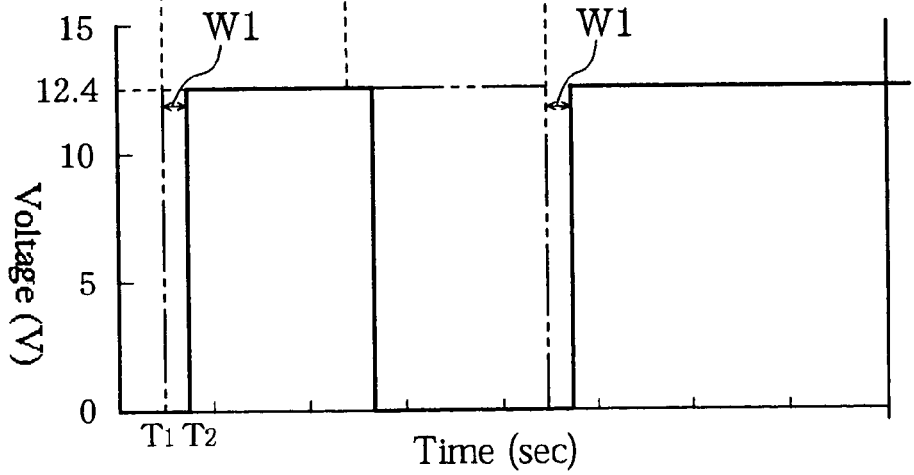

Next, the display operation of a display device having the above-described configuration is described. FIGS. 21(*a*) to 21(*c*) are timing charts of light-emission operation of an EL element. FIG. 21(*a*) is a waveform diagram of an image signal voltage, FIG. 21(*b*) is a waveform diagram of the voltage of a gate line GLa, and FIG. 21(*c*) is a waveform diagram of the voltage of a gate line GLb. For convenience of description, the description is made using, as an example, two vertically adjacent pixels 10*a* and 10*b*, shown in FIG. 22.

Figure 22:
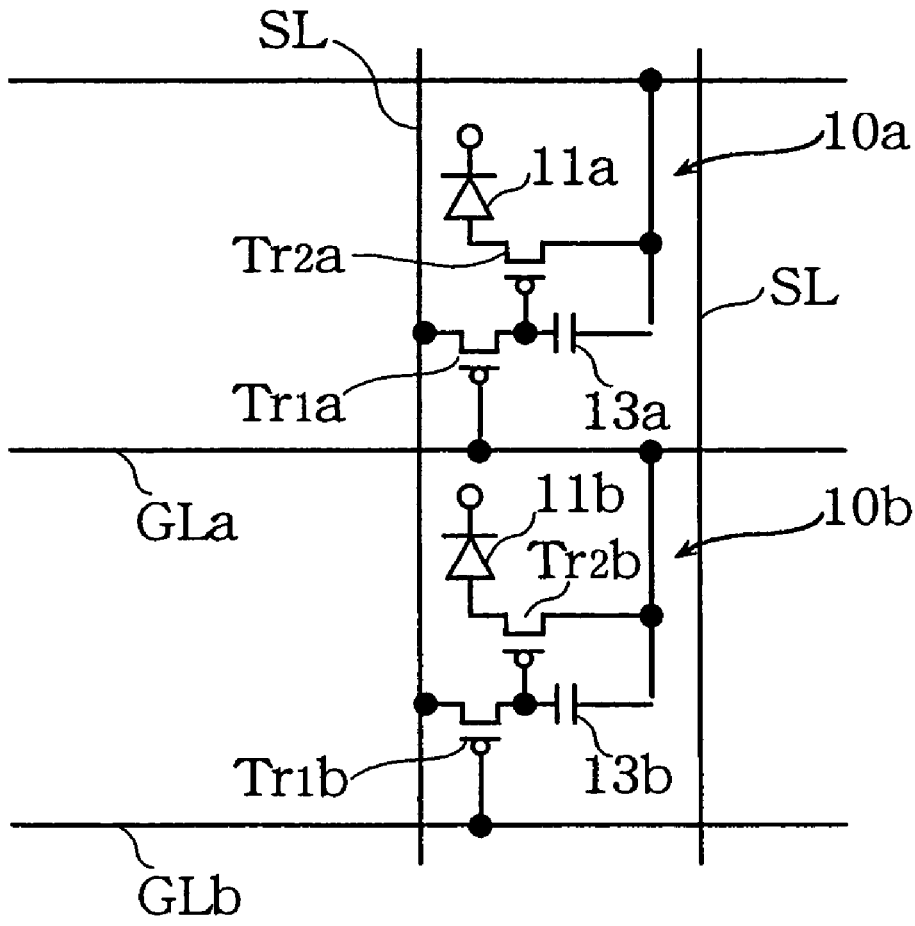
FIG. 22 is a configuration view of vertically adjacent pixels 10*a* and 10*b* for illustrating light-emission operation of the EL elements in Embodiment 7.

In FIG. 22, the subscript a is appended to the constitutional elements related to the pixel 10*a* (for example, the gate line is referred to as reference symbol GLa and the switching transistor is referred to as Tr1*a*, etc.), and the subscript b is appended to the constitutional elements related to the pixel 10*b* (for example, the gate line is referred to as reference symbol GLb and the switching transistor is referred to as Tr1*b*, etc.). In Embodiment 7, it is assumed that the potential of the cathode electrodes (the potential of the counter electrodes) of EL elements is set to 7.4 V.

First, as shown in FIG. 21(*c*), in write period W1 (from time T1 to time T2), the voltage level of a gate line GLb is a low level (which corresponds to level V1 and is 0 V in Embodiment 7), and thus a pixel 10*b* is selected. In write period W1, a switching transistor Tr1*b*, a P-channel transistor, is in the ON state, and therefore an image signal voltage (for example, 7.4 V) is applied, via source line SL, to the gate of a driver transistor Tr2*b* and an auxiliary capacitor 13*b*. Meanwhile, in the period from time T1 to time T2, an antecedent pixel 10*a* is in a non-selection period, as shown in FIG. 21(*b*), and thus an antecedent gate line GLa is at a high level (which corresponds to level V1 and is 12.4 V in Embodiment 7). Accordingly, a voltage of −5 V (=7.4−12.4) is applied between the gate and source of the driver transistor Tr2*b*, turning on the driver transistor Tr2*b*. Thereby, current flows from the anode electrode (pixel electrode) to the cathode electrode (counter electrode) of an EL element 11*b*, via the antecedent gate line GLa and the driver transistor Tr2*b*, whereby the EL element 11*b* emits light.

An EL element 11*a* emits light by the same operation as the above-described light-emission operation of the EL element 11*b*.

In the case of driving- a general-EL element, as indicated by virtual line M in FIG. 21(*b*), the antecedent gate line GLa maintains the high level until the write timing (time T4) of the present frame. In Embodiment 7, however, as shown in FIG. 21(*b*), at time T3, which is prior to time T4, the antecedent gate line GLa changes from the high level to the low level. Accordingly, the potential (0 V) of the antecedent gate line GLa becomes lower than the potential of the cathode electrode (7.4 V) of the EL element 11*b*. Thereby, the supplying of current to the EL element 11*b* stops, and the EL element 11*b* stops emitting light. In other words, at time T3, the pixel 10*b* goes into a blanking state. The antecedent gate line GLa maintains the low level until the write period W1 (from time T4 to time T5) of the antecedent pixel 10*a* has been completed. Hence, the EL element 11*b* is still in the blanking state.

In the antecedent gate line GLa, the low-level period from time T3 to time T4 is a period where the blanking signal V3 for blanking the pixel 10*b* is being output, and the low-level period from time T4 to time T5 is the write period W1 for writing an image signal to the pixel 10*a*. It is to be noted, however, that in the present embodiment the blanking signal voltage is set to a value equivalent to the low level (0 V) of the scan signal, and therefore the period throughout from time T3 to time T5 is a low-level period, as shown in FIG. 21(*b*).

Subsequently, at time T5, the potential of the antecedent gate line GLa changes from the low level to the high level. Thus, the current supplied from a further antecedent gate line (not shown in the figure) of the antecedent gate line GLa is controlled according to the potential having been written, in the write period, to the gate electrode of the driver transistor Tr2*a*, and flows through the EL element 11*a*, thereby emitting light. Here, since the image signal voltage in the write period (from time T4 to time T5) is 12.4 V, the light emission of the EL element 11*a* is still being stopped. Needless to say, when the image signal voltage is 7.4 V, the EL element 11*a* emits light.

The EL element 11*b* also operates in the same manner as the above EL element 11*a* and goes into the light-emitting state or the light-emitting stopping state according to the image signal voltage written to the gate electrode of the driver transistor Tr2*a*.

In the above example, the blanking signal voltage V3 was set to the same value as that of the low level (0 V) of the scan signal, but is not limited thereto. Specifically, the blanking signal voltage V3 is sufficient when it is smaller than the potential of the cathode electrode (counter electrode) of an EL element, making it possible to stop the current from flowing to the EL element. It is to be noted, however, that in such a case, the potential of the gate line GL requires three voltage level signals, V1 to V3, and therefore for the gate line driver circuit the gate line driver circuit 4 in Embodiment 1 should be used in place of the gate line driver circuit 4A.

In addition, in the blanking period of the EL element 11*b*, because the antecedent gate line GLa is at the low level, the switching transistor Tr1*a* is in the ON state; even if, for example, a voltage of 7.4 V is written to the driver transistor Tr2*a* in such a period, the blanking state of the EL element 11*a* does not change. This is because prior to the time when the EL element 11*b* goes into the blanking state, the EL element 11*a* is already in the blanking state. Thus, even if, for example, a voltage of 7.4 V is written to the driver transistor Tr2*a*, because the potential of the gate line that supplies a current to the EL element 11*a* (which is a gate line further previous to the antecedent gate line GLa) is at the low level, the potential of the gate electrode of the driver transistor Tr2*a* is not affected, current is not supplied to the EL element 11*a*, and the light emission is still being stopped.

In the above example, the light-emission and blanking operation of the vertically adjacent pixels 10*a* and 10*b* were described, but other pixels also emit light and perform blanking operation by the same operation.

As described above, in Embodiment 7, the gate line also serves as a current-supplying line, and blanking signals can be output from the gate lines.

For reference, it is also possible to use an N-channel transistor as the driver transistor Tr2, but the use of a P-channel transistor, such as that in the present embodiment, is preferable. This is because when the driver transistor Tr2 is formed with an N-channel transistor, the gate voltage for turning on the driver transistor Tr2 requires a higher voltage than the anode of an EL element, increasing the voltage necessary to drive an active matrix type EL element.

Embodiment 8

Figure 23:
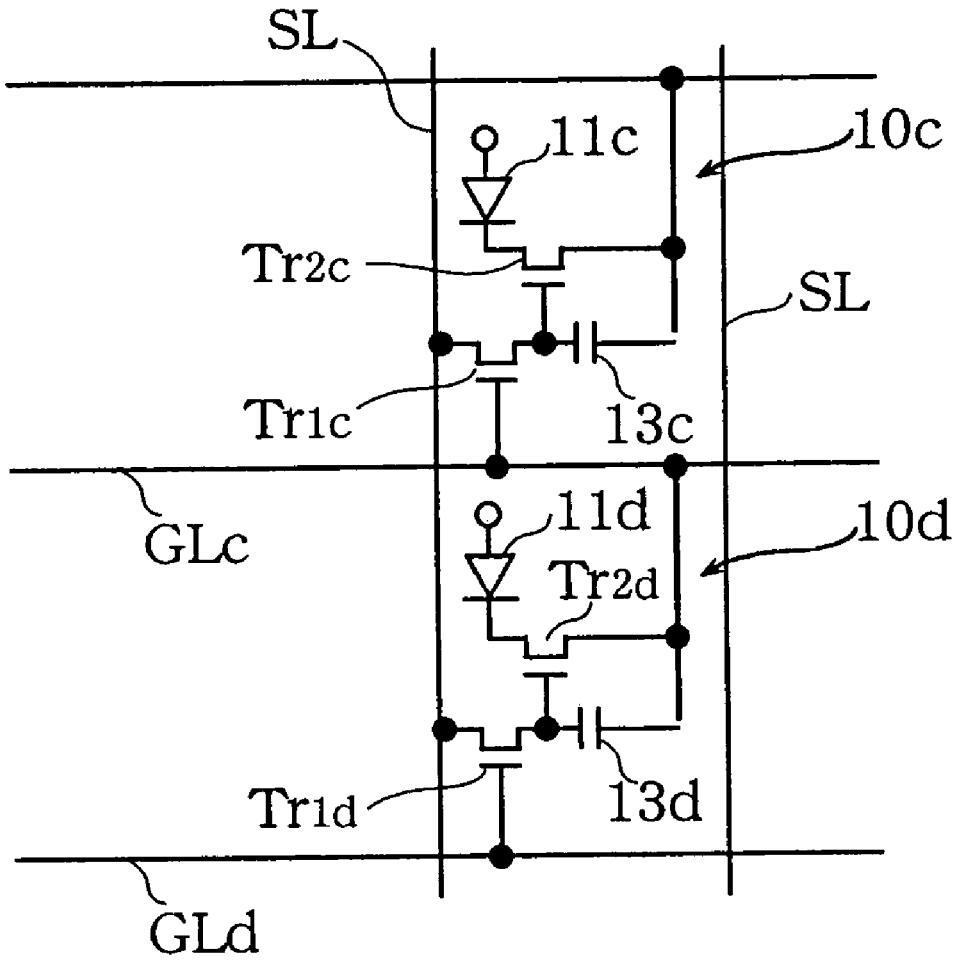
FIG. 23 is a circuit diagram of an EL display device according to Embodiment 8.
Figure 24:
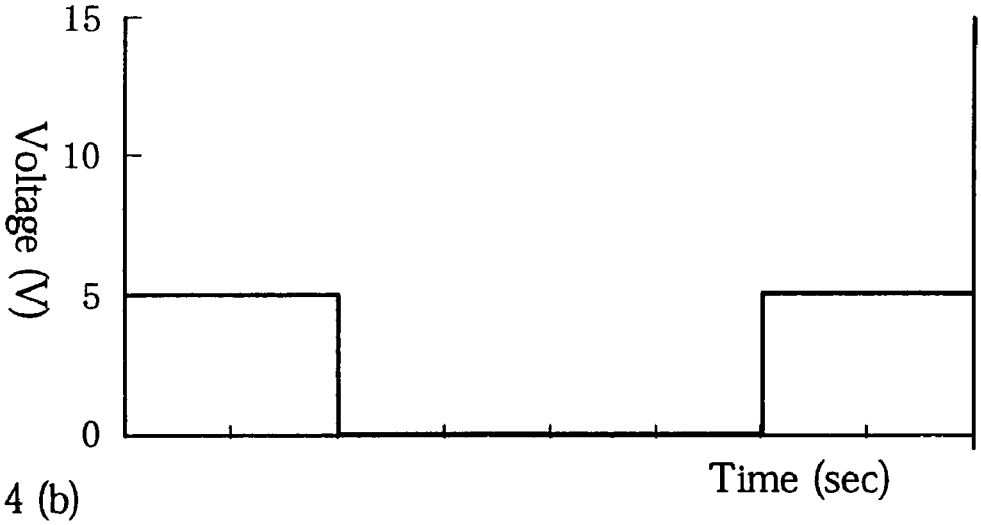
FIGS. 24(*a*) to 24(*c*) are timing charts of light-emission operation of the EL display device according to Embodiment 8.
Figure 24:
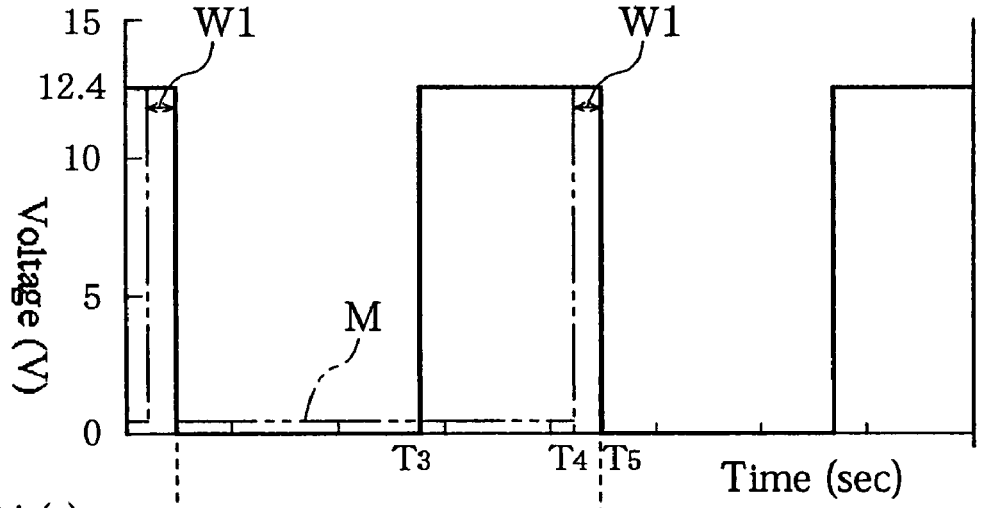
Figure 24:
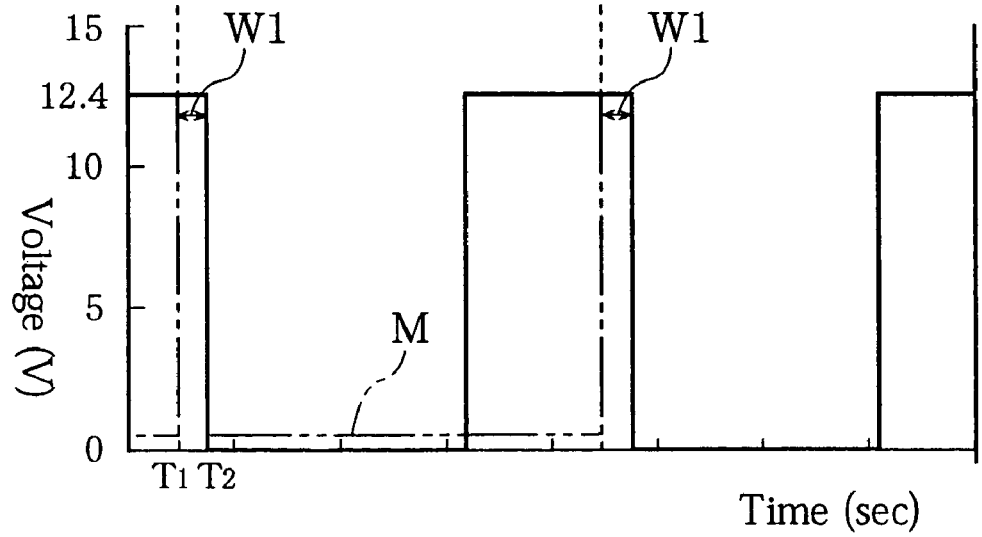

FIG. 23 is a circuit diagram of an EL display device according to Embodiment 8, and FIG. 24(*a*) to 24(*c*) are timing charts of light-emission operation of the EL display device according to Embodiment 8. FIG. 24(*a*) is a waveform diagram of an image signal voltage, FIG. 24(*b*) is a waveform diagram of the voltage of a gate line GLc, and FIG. 24(*c*) is a waveform diagram of the voltage of a gate line GLd. Embodiment 8 is similar to Embodiment 7, and thus like components are indicated by like reference numerals. In Embodiment 8, switching transistors and controlling transistors are N-channel transistors. In addition, the anode electrode of an EL element serves as a counter electrode and the cathode electrode serves as a pixel electrode, and the EL element is configured so as to emit light by the current flowing from the EL element to the gate line.

The light-emission and blanking operation in the present embodiment are described below, using, as an example, two vertically adjacent pixels 10*c* and 10*d*, shown in FIG. 23. In Embodiment 8, it is assumed that the potential of the anode electrode (the potential of the counter electrode) is set to 3.0 V.

First, as shown in FIG. 24(*c*), in write period W1 (from time T1 to time T2) of the pixel 10*d*, the voltage level of a gate line GLd is a high level (which corresponds to level V1 and is 12.4 V in Embodiment 8), and thus the pixel 10*d* is selected. In this write period W1, a switching transistor Tr1*d*, an N-channel transistor, is in the ON state, and therefore an image signal voltage (for example, 5.0 V) is applied, via source line SL, to the gate of a driver transistor Tr2*d* and an auxiliary capacitor 13*d*. Meanwhile, in the period from time T1 to time T2, an antecedent pixel 10*c* is in a non-selection period, as shown in FIG. 24(*b*), and thus an antecedent gate line GLc is at a low level (which corresponds to level V2 and is 0 V in Embodiment 8); in addition, since the potential of the anode electrode (the potential of the counter electrode) is set to 3.0 V, a voltage of 2 V (=5.0−3.0) is applied between the gate and source of the driver transistor. Tr2*d*, turning on the driver transistor Tr2*d*. Thereby, current flows from an EL element lid to the antecedent gate line GLc, whereby the EL element 11 emits light.

In the case of driving a general EL element, as indicated by virtual line M in FIG. 24(*b*), the antecedent gate line GLc maintains the low level until the write timing (time T4) of the present frame. In Embodiment 8, however, as shown in FIG. 24(*b*), at time T3, which is prior to time T4, the antecedent gate line GLc changes from the low level (which is 0 V in the present embodiment) to the high level. Accordingly, the potential (12.4 V) of the antecedent gate line GLc becomes higher than the potential (3.0 V) of the anode electrode of the EL element lid. Thereby, the supplying of current to the EL element lid stops, and the EL element lid stops emitting light. In other words, at time T3, the pixel 10*d* goes into a blanking state. The antecedent gate line GLc maintains the high level until the write period W1 (from time T4 to time T5) of the antecedent pixel 10*c* has been completed. Hence, the EL element lid is still in the blanking state. In such a manner, the EL element 11*d* emits light in one frame period in response to an image signal, and a blanking state, in which light-emission stops, can be obtained. The rest of the EL elements other than the EL element lid also emit light and perform blanking operation in the same manner as the EL element lid.

In the present embodiment too, a blanking period can be thus inserted in one frame.

In the antecedent gate line GLc, the high-level period from time T3 to time T4 is a period where the blanking signal V3 for blanking the pixel 10*d* is being output, and the high-level period from time T4 to time T5 is the write period W1 for writing an image signal to the pixel 10*c*. It is to be noted, however, that in the present embodiment the blanking signal voltage is set to a value equivalent to the high level (12.4 V) of the scan signal, and therefore the period throughout from time T1 to time T5 is a low-level period, as shown in FIG. 24(*b*).

In the above example, the blanking signal voltage V3 was set to the same value as that of the high level (12.4 V) of the scan signal, but is not limited thereto. Specifically, the blanking signal voltage V3 is sufficient when it is higher than the potential of the anode electrode (counter electrode) of an EL element, making it possible to stop the current from flowing to the EL element.

Embodiment 9

Embodiment 9 is characterized in that the configuration of Embodiment 7 is made such that the sum of the impedance of a designated gate line GL and the output impedance of a buffer in the last stage in a gate line driver circuit 4A connected to the designated gate line GL is 20% or less of the impedance of EL elements connected parallel to the designated gate line GL. By thus controlling the impedance, a sufficient voltage can be applied to the EL elements and thus a uniform display can be realized. The reason that a uniform display can be realized by controlling the impedance is described below, with reference to FIGS. 25 and 26.

Figure 25:
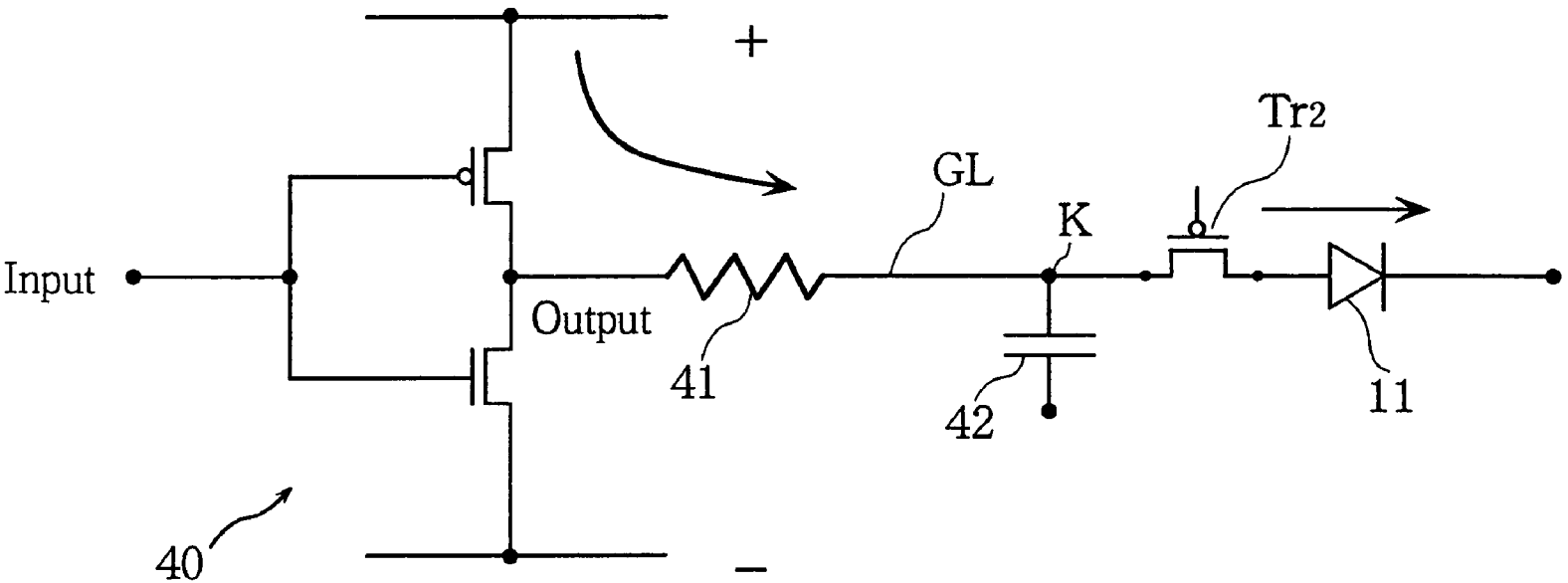
FIG. 25 shows an equivalent circuit, which includes a gate line, an EL element driven by current flowing through the gate line, etc., in the case where a pixel electrode connected to a driver transistor serves as an anode electrode.
Figure 26:
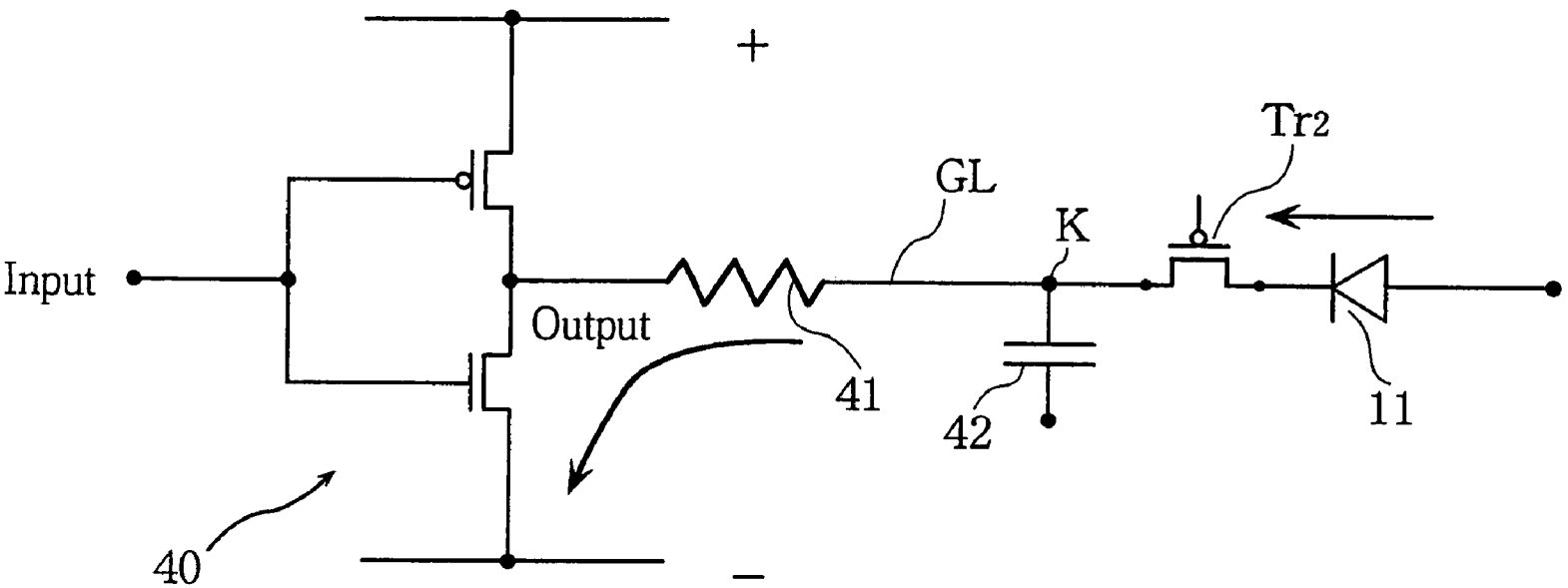
FIG. 26 shows an equivalent circuit, which includes a gate line, an EL element driven by current flowing through the gate line, etc., in the case where a pixel electrode connected to a driver transistor serves as a cathode electrode.

FIG. 25 shows an equivalent circuit, in the case where a pixel electrode connected to a driver transistor serves as an anode electrode, which includes a gate line, an EL element driven by the current flowing through the gate line, etc. FIG. 26 shows an equivalent circuit, in the case where a pixel electrode connected to a driver transistor serves as a cathode electrode, which includes a gate line, an EL element driven by the current flowing through the gate line, etc. In FIGS. 25 and 26, reference numeral 40 indicates a buffer in the last stage in a gate line driver circuit 4A, reference numeral 41 indicates the resistance of a gate line GL, and reference numeral 42 indicates the capacity of the gate line GL. As shown in FIG. 25, when the anode electrode of an EL element 11 serves as a pixel electrode, current flows through the EL element 11 via the output impedance of the buffer 40 and the impedance of the gate line GL. As shown in FIG. 26, when the cathode electrode of an EL element 11 serves as a pixel electrode, current flows from the EL element 11 to a gate line GL. In any of the types shown in FIGS. 25 and 26, when the output impedance of the buffer 40 and the impedance of the gate line GL are higher than the impedance of the EL element 11, a voltage drop occurs, upon the flow of current, across the gate line and the like, and thus a sufficient voltage cannot be applied to the EL element 11.

Figure 27:
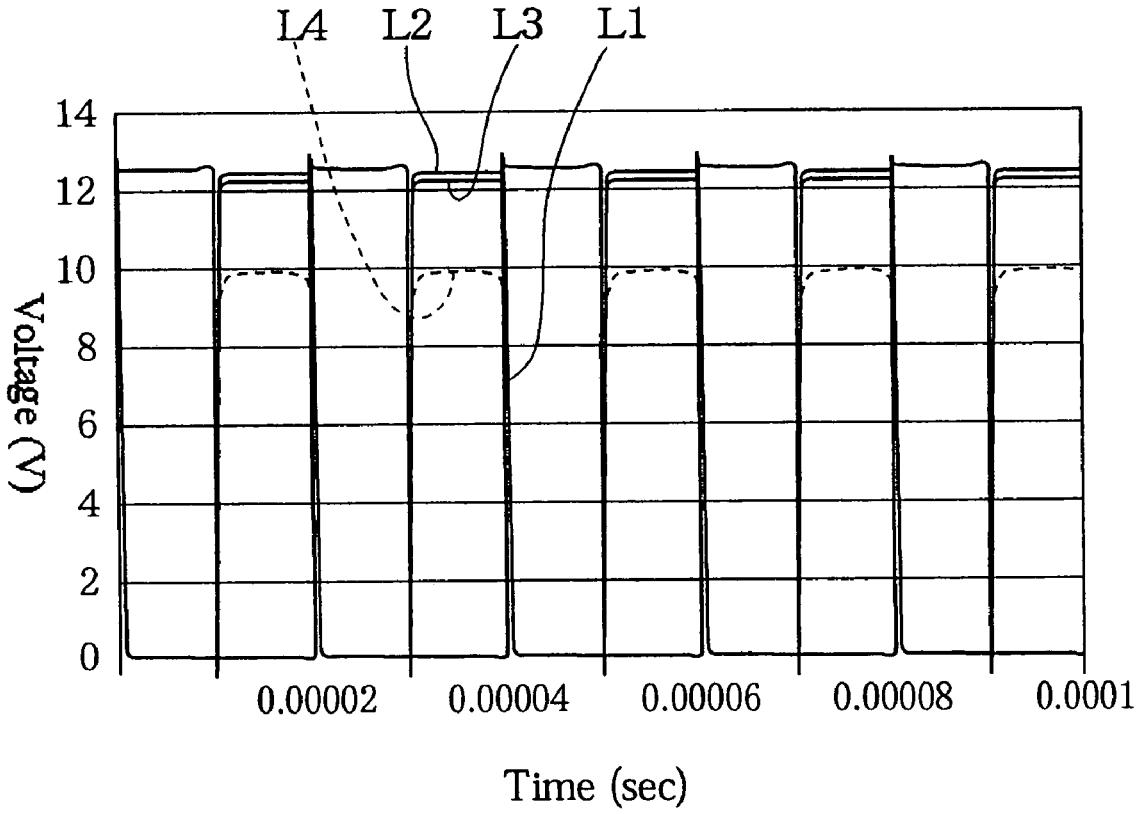
FIG. 27 is a graph showing the results of a circuit simulation performed on the equivalent circuits shown in FIGS. 25 and 26.

The results of a circuit simulation performed on these equivalent circuits are shown in FIG. 27. In FIG. 27, line Li indicates the input to the buffer 40, line L2 indicates the output from the buffer 40, line L3 indicates the potential of the end K of the GL line (see FIGS. 25 and 26) in the case where the sum of the impedance of the gate line GL and the output impedance of the buffer 40 is about 2% of the impedance of the gate line, and line L4 indicates the potential of the end K of the GL line in the case where the sum of the impedance of the gate line GL and the output impedance of the buffer 40 is 20% of the impedance of-the gate line GL. As is clear from FIG. 27, it is recognized that when the sum of the output impedance and the impedance of the gate line GL exceeds 20% of the impedance of an EL element 11 in each pixel, the potential of the end K of the gate line GL significantly decreases. Accordingly, a sufficient voltage cannot be applied to the EL elements 11 and thus a uniform display cannot be obtained.

In order to reduce the output impedance of the gate line driver circuit 4A, a voltage follower, for example, may-be provided to the last stage in the gate line driver circuit.

Embodiment 10

Figure 28:
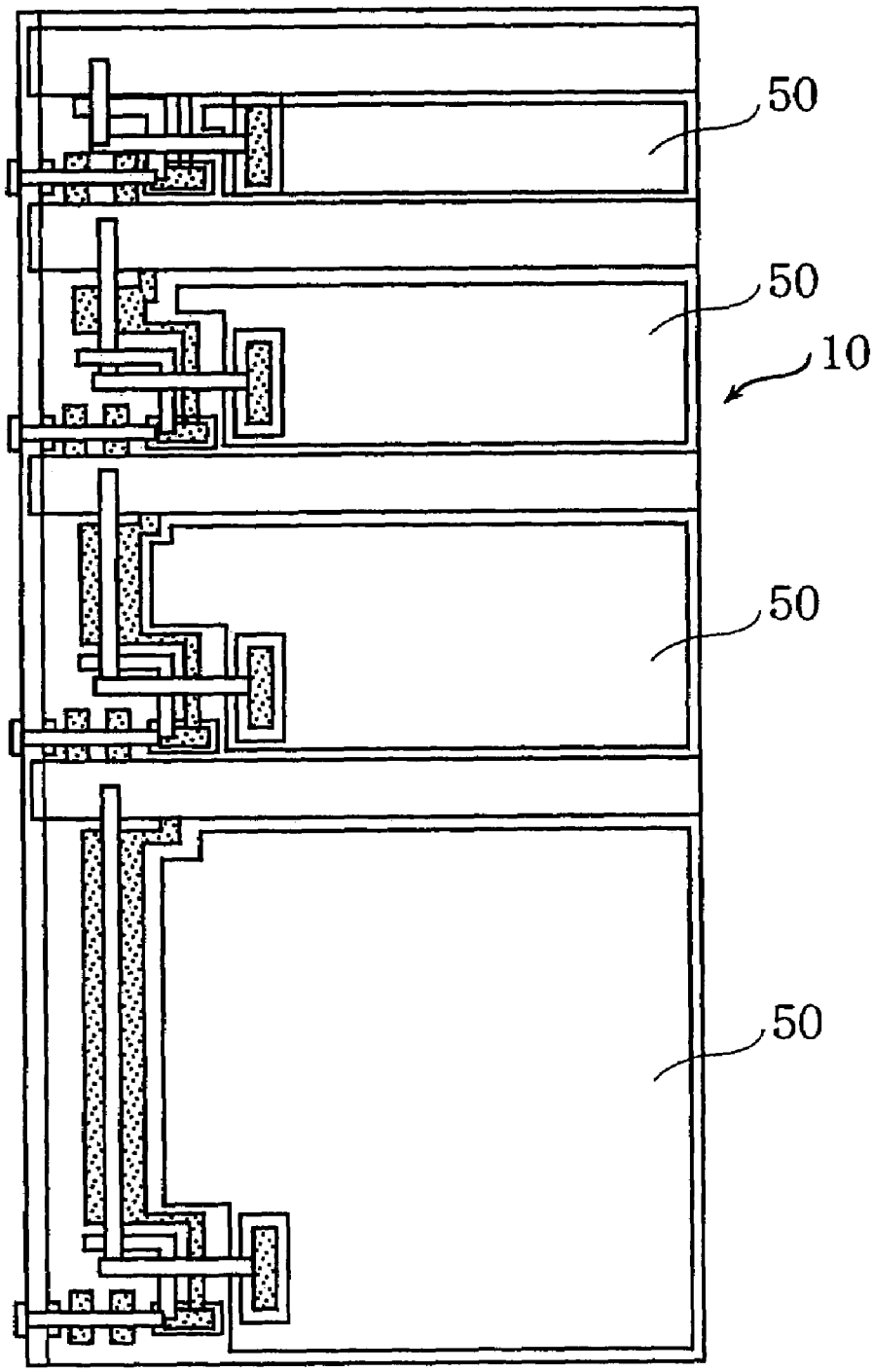
FIG. 28 is a plane view of a display portion of a display device according to Embodiment 10.
Figure 29:
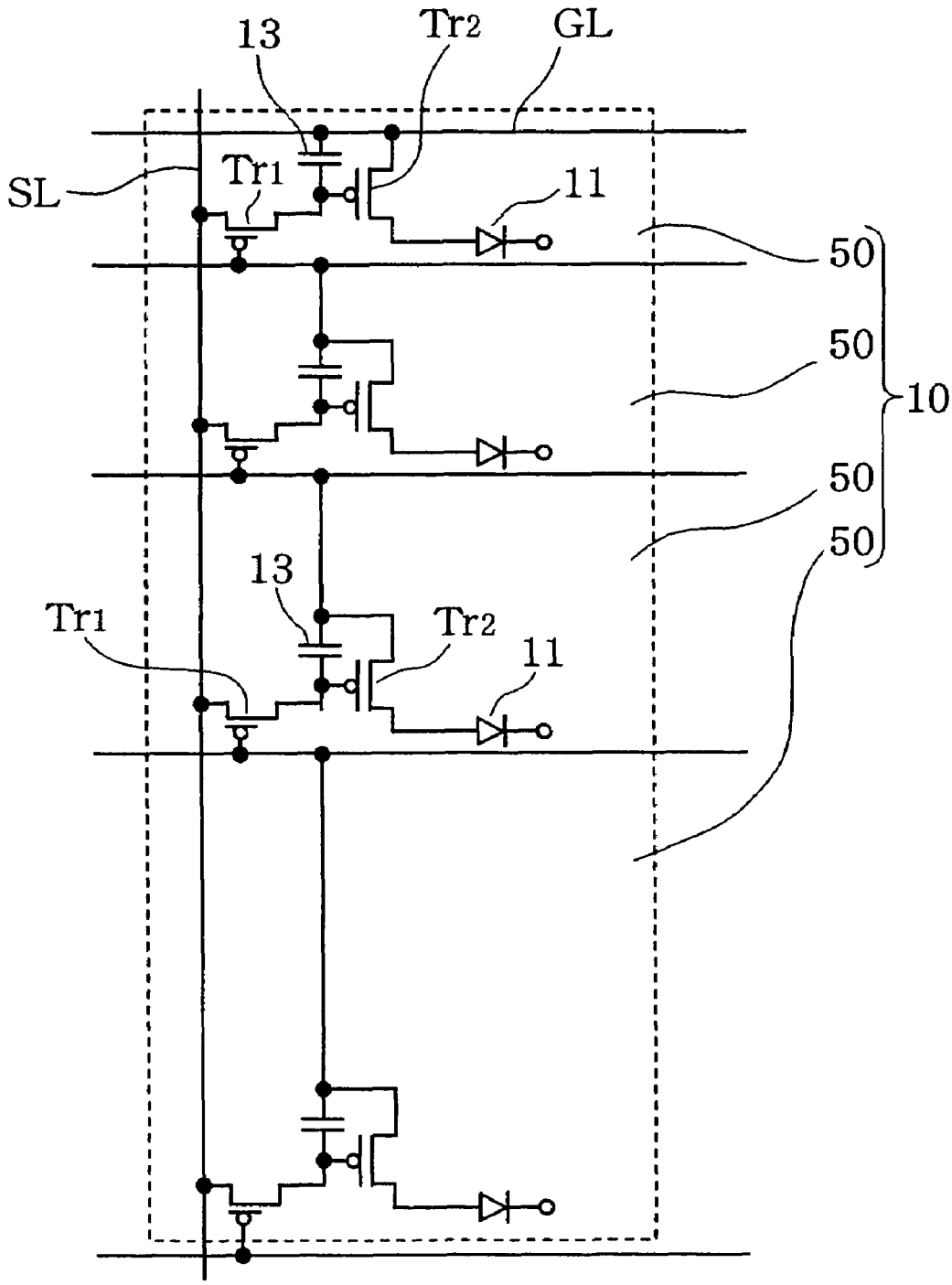
FIG. 29 is a circuit diagram of the display device according to Embodiment 10.

FIG. 28 is a plane view of a display portion of a display device according to Embodiment 10, and FIG. 29 is a circuit diagram of the display device. FIGS. 28 and 29 show only the configuration related to one pixel. Embodiment 10 is characterized in that one unit pixel in Embodiment 7 is split into a plurality of regions and gray-scale display is provided by a spatial dithering method. With reference to FIGS. 28 and 29, the specific configuration is described below. A unit pixel 10 is structured so as to be split into a plurality of regions (four regions in this Embodiment 10). The configuration of sub-pixels 50, split regions, is the same as that of the unit pixel 10 in the foregoing Embodiment 1. Specifically, each of the sub-pixels 50 has a gate line GL, a switching transistor Tr1, a driver transistor Tr2, and an auxiliary capacitor 13. It is preferable that the source of the driver transistor Tr1 be connected to the gate line to which an adjacent sub-pixel belongs. Gray-scale display can be realized by the combination of light-emission and non-light-emission of the split sub-pixel regions. To a source line SL, a digital image signal is supplied.

Specifically, gray-scale display is provided by weighing the areas of light-emitting portions of EL elements 11 in the sub-pixels 50, a plurality of split regions, so as to correspond to bits. By thus weighting the area ratio of the light-emitting portions so as to correspond to bits such as 1:2:4: . . . :2(n−1), but not by dividing the area equally, it becomes possible to provide $2^n$-gray-scale display.

Figure 30:
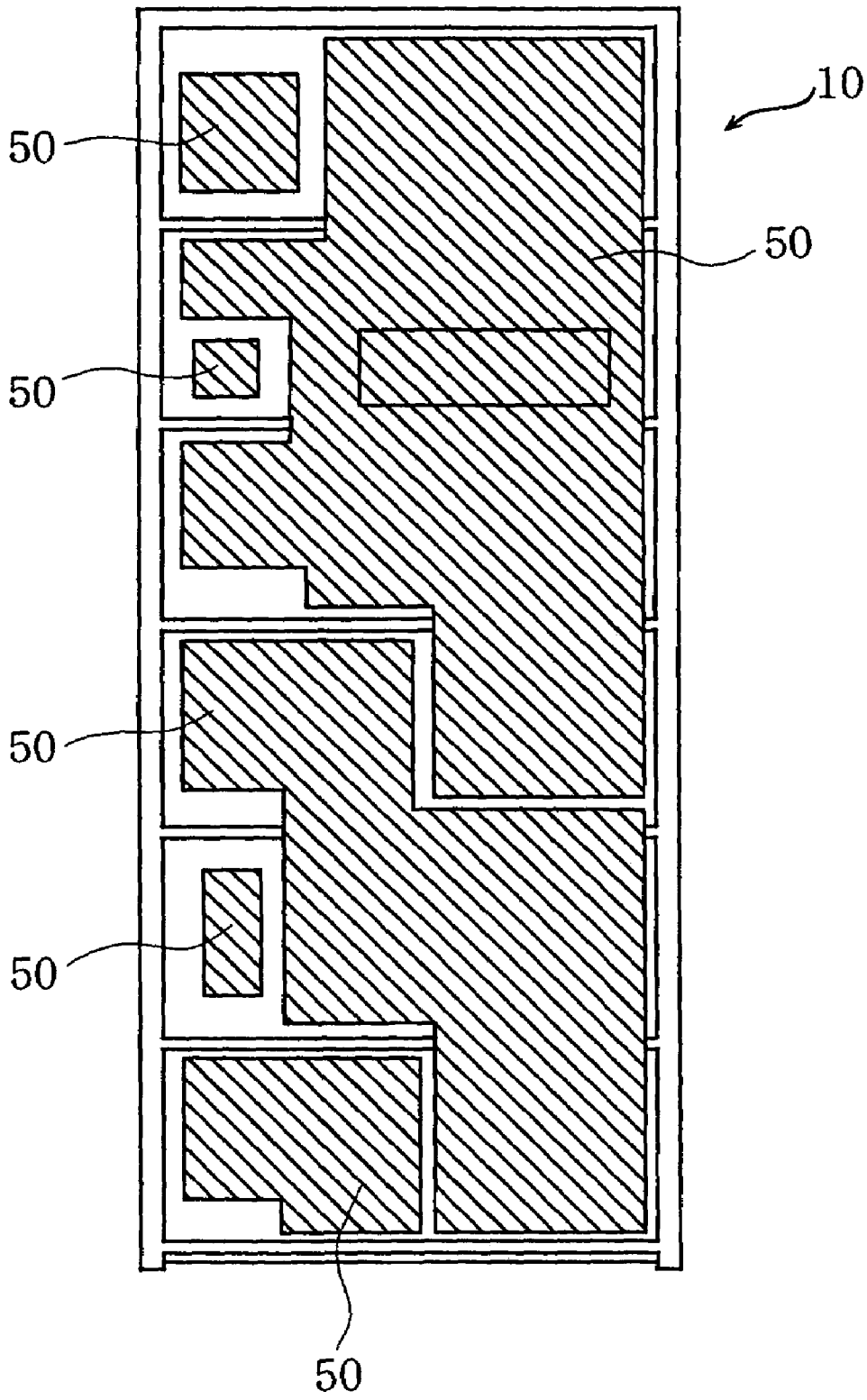
FIG. 30 is a plane view showing a modified example of the display portion of the EL display device according to Embodiment 10.

In an example shown in FIG. 28, 16-gray-scale display can be provided by 4-bit data. In addition, in a configuration, as shown in FIG. 30, in which six sub-pixels 50 are provided, 64-gray-scale display can be provided by 6-bit data. Needless to say, the electrode layout of the sub-pixels is not limited to those shown in FIGS. 28 and 30.

Thus, in the present invention having a configuration that does not require a dedicated current-supplying line and that can increase the aperture ratio of the pixels, the use of, in particular, spatial dithering methods is extremely effective for realizing an active matrix type EL display device with a uniform display and excellent gray-scale performance.

Embodiment 11

Figure 31:
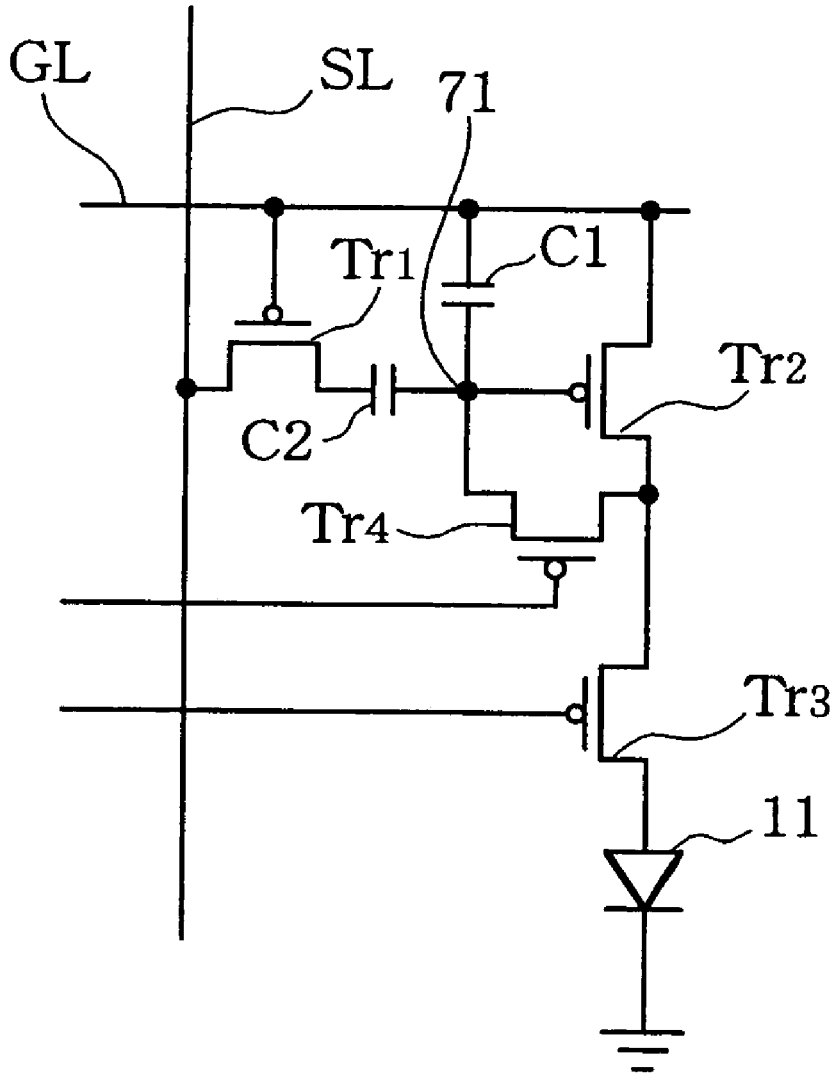
FIG. 31 is a circuit diagram of an active matrix type EL display device according to Embodiment 11.
Figure 32:
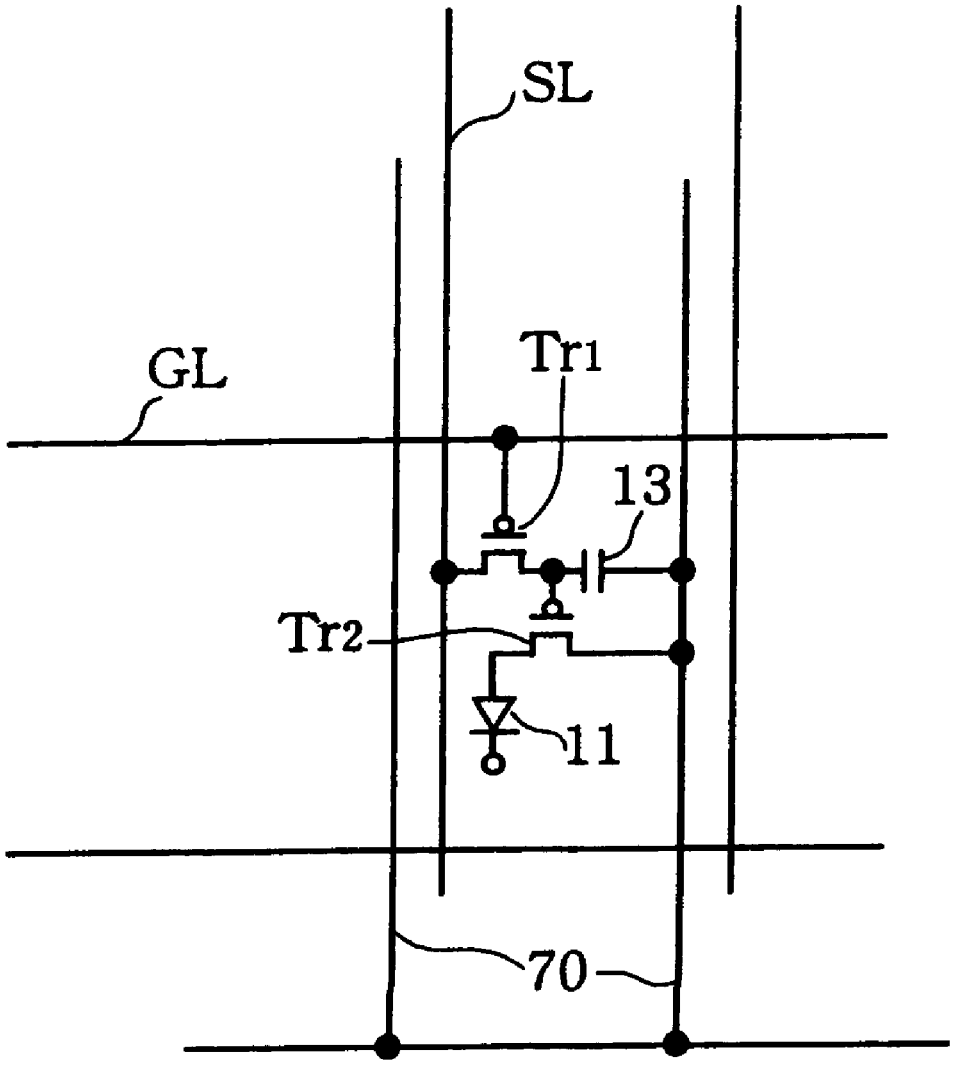
FIG. 32 is a circuit diagram showing the configuration of a prior art example.
Figure 33:
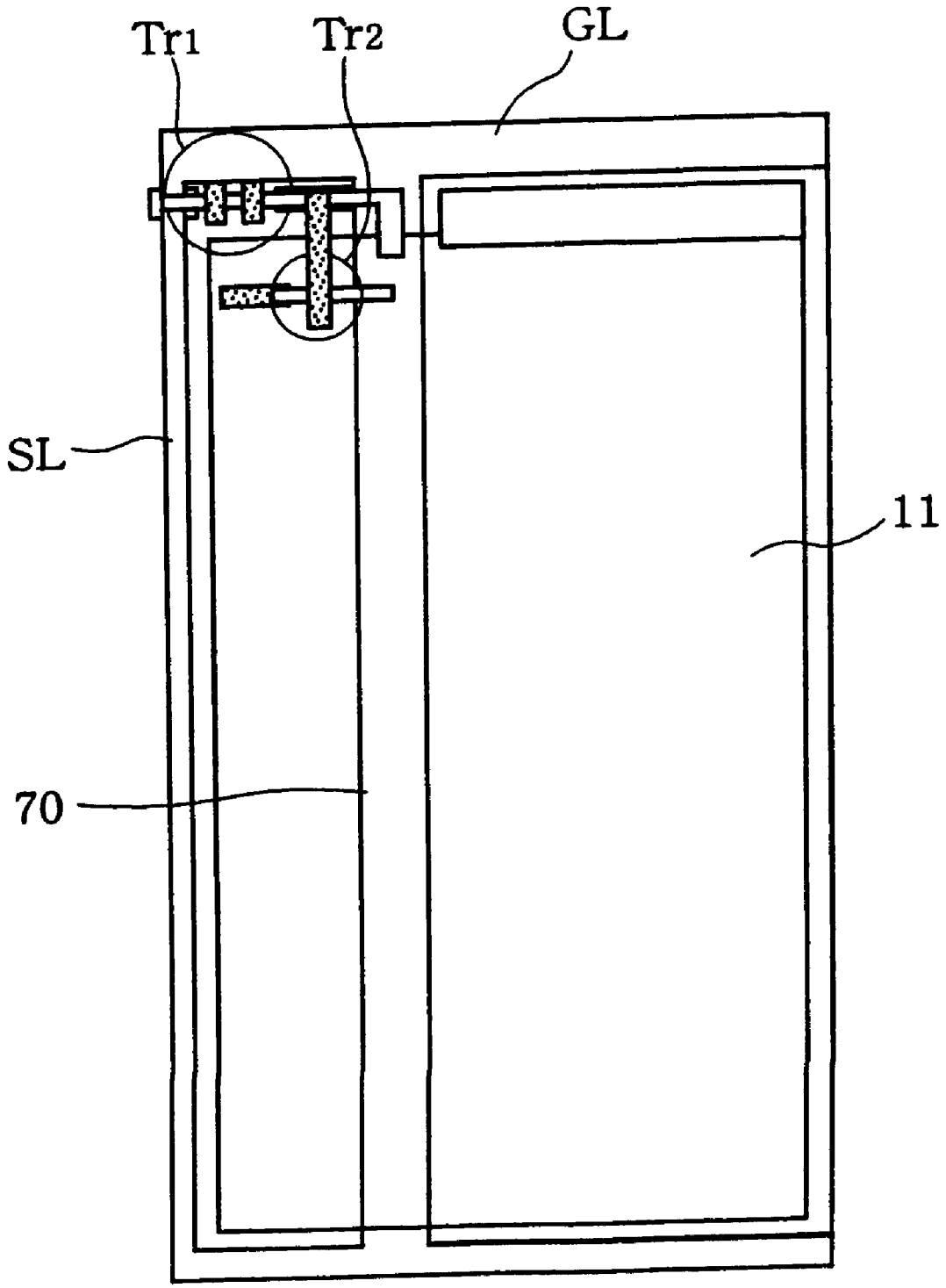
FIG. 33 is a plane view showing the configuration of the prior art example.

FIG. 31 is a circuit diagram of an active matrix type EL display device according to Embodiment 11. Embodiment 11 is similar to Embodiment 7, and thus like components are indicated by like reference numerals. FIG. 31 shows only the configuration related to a unit pixel. Embodiment 11 is characterized in that a circuit has an offset canceller function, and there are provided, in addition to a switching transistor Tr1 and a driver transistor Tr2, a switching transistor Tr3, in which the ON/OFF states are controlled by a current switch signal, and a switching transistor Tr4, in which the ON/OFF states are controlled by a transistor reset signal.

Next, the offset canceller function of the above-described circuit is described. First, the threshold voltage Vt of the transistor Tr2 is memorized in a condenser C1. Specifically, in the period in which the transistor Tr1 is in the OFF state, the transistor Tr3 is turned off and the transistor Tr4 is turned on. Thereby, the voltage between the terminals of the condenser C1 rises to Vt. That is, Vt has been memorized in the condenser Cl. At this point, when the potential of a gate line GL is Vdd, the potential of a connection point 71 is Vdd−Vt.

Subsequently, the transistor Tr3 is turned on and the transistor Tr4 is turned off, and accordingly an EL element and the gate line GL (which corresponds to a current-supplying line) go into a connected state.

Then, with the transistor Tr3 being in the ON sate and the transistor Tr4 being in the OFF state, the transistor Tr1 is turned on and the image signal voltage Von is applied to the gate of the transistor Tr2 via a condenser C2. At this point, since Vt is memorized in the condenser C1 in advance, the potential of the connection point 71 (which corresponds to the potential of the gate of the transistor Tr2) is Von+Vdd+Vt. Hence, the current value of the transistor Tr2 is f (Von+Vdd+Vt−Vt) and Vt is a function of the offset value, and therefore, even if there is variation in the threshold value Vt of the transistor Tr2, the EL element can be driven without being affected by the variation.

In the present embodiment, in a configuration having the above-described offset canceller function, the gate line GL is connected to the source of the driver transistor Tr2, whereby a current can be supplied from the gate line GL to the EL element 11 as is the case with the foregoing embodiment, and a blanking signal can be provided from the gate line GL.

Supplementary Remarks (1) In the foregoing Embodiments 1 to 4, the gates of driver transistors were connected to a next gate line via auxiliary capacitors, and a blanking signal was provided from the next gate line, but the present invention is not limited thereto. Specifically, instead of the next gate line, any of the gate lines may be connected to auxiliary capacitors so as to provide a blanking signal from the any of the gate lines. Hence, it is possible to use, for example, the gate line to which a selected pixel itself belongs. In this case, however, with a change from the ON to OFF state of the selected pulse, due to the influence of the parasitic capacitors of the driver transistors connected to the gate line to which the pixel itself belongs, the potential of the pixel electrodes is expected to change; in order to prevent this from happening, a large storage capacitor needs to be added. In view of this, by making the gate line for providing a blanking signal serve as a next gate line, such a problem can be overcome. This is because when the gate line for providing a blanking signal serves as a next gate line, advantages are provided that the routing of the lines can be done with a minimum length and the potential variation caused by the parasitic capacitors of the transistors can be suppressed to the minimum. Therefore, it is preferable that the designated gate line be the next gate line of the pixel.

(2) For the switching transistor Tr1 in the foregoing Embodiments 1 to 11, such characteristics as small leak current are required, i.e., those having excellent data storage characteristics are preferably used. Therefore, for the switching transistor Tr1, it is preferable to use one having a multi-gate structure, in which a plurality of transistors are connected to each other in series, or having an LDD (Lightly Doped Drain) structure, with which excellent off characteristics can be obtained.

(3) The transistors Tr1 and Tr2 in the foregoing Embodiments 1 to 11 may be made of amorphous silicon or polysilicon. The case of forming the transistors with polysilicon is advantageous particularly when a plurality of transistors are used in one pixel, such as the case with the present invention, because polysilicon has higher mobility than amorphous silicon and thus microfabrication of elements is easily obtained.

(4) In the foregoing Embodiments 1 to 11, in the case where the transistors are fabricated with low-temperature polysilicon, it is also possible to integrally form, on a glass substrate, at least one of the gate line driver circuit and the source line driver circuit, simultaneously with the fabrication of transistors in the pixel portion. By thus making a peripheral driver circuit a built-in driver circuit, power consumption can be significantly reduced and a reduction in the weight and thickness of an entire display device can be realized.

(5) Upon driving the display devices of Embodiments 7 to 11, the display devices may be driven under such operating conditions that the driver transistors Tr2 are operated in the linear region, as in the case with Embodiment 4.

(6) In Embodiments 7 to 11, as a designated gate line, the gate line previous to a gate line connected to a selected pixel was selected, but the present invention is not limited thereto. The designated gate line may be any of the gate lines; for example, it is also possible to use the gate line to which a selected pixel itself belongs. In this case, however, with a change from the ON to OFF state of a selected pulse, due to the influence of the parasitic capacitors of the driver transistors connected to the gate line to which the pixel itself belongs, the potential of the pixel electrode is expected to change; in order to prevent this from happening, a large storage capacitor needs to be added. In view of this, by making the antecedent gate line serve as the designated gate line, such a problem can be overcome. This is because the potential of the gate electrodes of the driver transistors is held constant from completion of write to a selected pixel to start of write to a pixel in the present frame which belongs to an antecedent gate line of the gate line to which the selected pixel belongs. Besides, by making the antecedent gate line serve as the designated gate line, advantages are provided that the routing of the lines can be done with a minimum length and the potential variation caused by the parasitic capacitors of the transistors can be suppressed to the minimum. Thus, it is preferable that, as the designated gate line, the gate line previous to the pixel be selected.

(7) The present invention is not limited to Embodiments 1 to 11, and may have a configuration in which any of Embodiments 1 to 11 is appropriately selected and combined.

INDUSTRIAL APPLICABILITY

As described above, the present invention exhibits the following advantageous effects.

(1) An EL element in each pixel emits light in response to an image signal, and thus a desired image is displayed; in addition, a blanking period, in which the EL elements do not emit light, is inserted in one frame. Accordingly, when displaying a moving image, a black display is inserted between an image of the previous frame and an image of the present frame. Consequently, an after-image phenomenon is suppressed, making it possible to perceive a clear image.

(2) By supplying blanking signals via gate lines, transistors dedicated to blanking and wiring for blanking signals become unnecessary. Omission of such transistors and wiring improves the aperture ratio.

(3) By supplying a current from a designated gate line to EL elements, a current-supplying line dedicated to supplying a current to the EL elements becomes unnecessary. Consequently, the aperture ratio can be increased compared to the prior-art example, and the occurrence of line defects caused by interlayer or intralayer short circuits resulting from the current-supplying line can be prevented, making it possible to configure an EL display device with improved yield,

What is claimed is:

1. An EL display device comprising:

a display portion including a plurality of gate lines, to which scan signals are supplied, a plurality of source lines, to which image signals are supplied, and unit pixels arranged in a matrix, each of the unit pixels having an EL element, a driver transistor for controlling, via a current-supplying line, the amount of current supplied to the EL element, and a switching transistor in which switching operation changes with a scan signal, the switching transistor switching, according to change of the switching operation, between conduction and blocking between the source line and a gate electrode of the driver transistor;

a source line driver circuit for supplying image signals to the source lines; and a gate line driver circuit for supplying scan signals to the gate lines and outputting, via the gate lines, blanking signals within hold times in which voltages written to the gate electrodes of the driver transistors are held, the blanking signals forcibly stopping a light-emitting state of the EL elements, wherein each unit pixel comprises an auxiliary capacitor having electrodes, one connected to the gate electrode of the driver transistor and the other to a designated gate line among the plurality of gate lines, wherein a designated gate line selected from any one of the plurality of gate lines is connected to anode electrodes of the EL elements via controlling transistors, and cathode electrodes of the EL elements are configured as counter electrodes, the designated gate line also serves as the current-supplying line, and the EL elements are driven to emit light by current flowing from the designated gate line to the EL elements, and the blanking signals are supplied from the designated gate line and are signals set to a voltage level lower than a potential of the cathode electrodes of the EL elements.

2. An EL display device comprising:

a display portion including a plurality of gate lines, to which scan signals are supplied, a plurality of source lines, to which image signals are supplied, and unit pixels arranged in a matrix, each of the unit pixels having an EL element, a driver transistor for controlling, via a current-supplying line, the amount of current supplied to the EL element, and a switching transistor in which switching operation changes with a scan signal, the switching transistor switching, according to change of the switching operation, between conduction and blocking between the source line and a gate electrode of the driver transistor;

a source line driver circuit for supplying image signals to the source lines; and a gate line driver circuit for supplying scan signals to the gate lines and outputting, via the gate lines, blanking signals within hold times in which voltages written to the gate electrodes of the driver transistors are held, the blanking signals forcibly stopping a light-emitting state of the EL elements, wherein each unit pixel comprises an auxiliary capacitor having electrodes, one connected to the gate electrode of the driver transistor and the other to a designated gate line among the plurality of gate lines, wherein a designated gate line selected from any one of the plurality of gate lines is connected to cathode electrodes of the EL elements via controlling transistors, and anode electrodes of the EL elements are configured as counter electrodes, the designated gate line also serves as the current-supplying line, and the EL elements are driven to emit light by current flowing from the EL elements to the designated gate line, and the blanking signals are supplied from the designated gate line and are signals set to a voltage level higher than a potential of the anode electrodes of the EL elements.

3. The EL display device according to claim 1, wherein the designated gate line is an antecedent gate line.

4. The EL display device according to claim 1, wherein the sum of impedance of the designated gate line and output impedance of a buffer in last stage in the gate line driver circuit connected to the designated gate line is 20% or less of impedance of the EL elements connected to the designated gate line.

5. The EL display device according to claim 1, wherein:

each of the unit pixels is split into a plurality of sub-pixels;

the sub-pixels each individually have a sub-pixel electrode, a switching transistor, a controlling transistor, an auxiliary capacitor, and a gate line; and gray-scale display is provided by combination of ON/OFF states of each of the sub-pixels, and a blanking signal is provided to each of the sub-pixels via the gate line.

6. The EL display device according to claim 5, wherein areas of light-emitting portions of the EL elements in the sub-pixels are weighted so as to correspond to bits to be input according to gray-scale to be displayed.

* * * * *